US008855514B2

(12) United States Patent
Shirakata

(10) Patent No.: US 8,855,514 B2
(45) Date of Patent: Oct. 7, 2014

(54) IMAGE FORMING APPARATUS HAVING STRETCHING ROLLER CORRECTION

(71) Applicant: Canon Kabushiki Kaisha, Tokyo (JP)

(72) Inventor: Jiro Shirakata, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/905,545

(22) Filed: May 30, 2013

(65) Prior Publication Data

US 2013/0336668 A1 Dec. 19, 2013

Related U.S. Application Data

(62) Division of application No. 12/903,427, filed on Oct. 13, 2010, now Pat. No. 8,472,821.

(30) Foreign Application Priority Data

Oct. 22, 2009 (JP) ..... 2009-243171

(51) Int. Cl.
*G03G 15/01* (2006.01)
*G03G 15/16* (2006.01)
*G03G 15/00* (2006.01)

(52) U.S. Cl.
CPC .... *G03G 15/5008* (2013.01); *G03G 2215/0161* (2013.01); *G03G 2215/0016* (2013.01); *G03G 15/0131* (2013.01); *G03G 2215/00059* (2013.01); *G03G 15/0178* (2013.01); *G03G 2215/0129* (2013.01); *G03G 15/5054* (2013.01); *G03G 15/5058* (2013.01); *G03G 15/1615* (2013.01)
USPC ..... 399/49; 399/301

(58) Field of Classification Search
USPC ..... 399/49, 301, 165
See application file for complete search history.

(56) References Cited

U.S. PATENT DOCUMENTS 4,989,946 A 2/1991 Williams et al.
7,502,584 B2 * 3/2009 Takeyama ..... 399/301 X
(Continued)

FOREIGN PATENT DOCUMENTS

JP 3-28816 A 2/1991
JP 2009-25626 A 2/2009
(Continued)

OTHER PUBLICATIONS

Notice of Allowance dated Nov. 20, 2012, in Korean Application No. 10-2010-0103068.

*Primary Examiner* — Sophia S Chen
(74) *Attorney, Agent, or Firm* — Fitzpatrick, Cella, Harper & Scinto

(57) ABSTRACT

An image forming apparatus includes first and second image bearing members configured to bear electrostatic latent images, a rotatable belt configured to receive toner images from the first and second image bearing members, and an executing portion configured to execute an operation in a correction mode for determining timing at which formation of the electrostatic latent image starts on at least one of the first and second image bearing members with respect to a widthwise direction of the belt between test toner images transferred onto the belt from the first and second image bearing members. In addition, first and second detecting members detect positions of the belt with respect to the widthwise direction, and a calculating portion calculates a movement distance of a predetermined point on the belt with respect to the widthwise direction. An adjusting portion adjusts the timing determined by the executing portion on the basis of a result of the calculation in the correction mode and a result of the calculation of the calculating portion when the image is to be formed in accordance with an image formation signal.

12 Claims, 24 Drawing Sheets

(56) References Cited

U.S. PATENT DOCUMENTS

| | | | |
|---|---|---|---|
| 2009/0148198 | A1 | 6/2009 | Suzuki et al. |
| 2009/0162098 | A1 | 6/2009 | Shirakata |
| 2010/0028058 | A1 | 2/2010 | Eom |

FOREIGN PATENT DOCUMENTS

| | | | |
|---|---|---|---|
| KR | 10-0378171 | B1 | 3/2003 |
| KR | 10-2007-0077951 | A | 7/2007 |

* cited by examiner (a)

$$y(n)=\lambda_1 * y(n-1)+\lambda_2 * y(n-2)+\cdots+\lambda_p * y(n-p)$$
$$+\varepsilon_0 * u(n)+\varepsilon_1 * u(n-1)+\cdots+\varepsilon_q * u(n-q)$$

(b)

$$\begin{cases} \begin{pmatrix} X_1(n+1) \\ X_2(n+1) \\ \vdots \\ X_S(n+1) \end{pmatrix} = \begin{pmatrix} \alpha_{11} & \alpha_{12} & \cdots & \alpha_{1s} \\ \alpha_{21} & \alpha_{21} & \cdots & \alpha_{2s} \\ \vdots & \vdots & & \vdots \\ \alpha_{s1} & \alpha_{s1} & \cdots & \alpha_{ss} \end{pmatrix} \begin{pmatrix} X_1(n) \\ X_2(n) \\ \vdots \\ X_S(n) \end{pmatrix} + \begin{pmatrix} \beta_{11} \\ \beta_{21} \\ \vdots \\ \beta_{S1} \end{pmatrix} U_1(n) \\ y(n) = \begin{pmatrix} \gamma_{11} & \gamma_{12} & \cdots & \gamma_{1S} \end{pmatrix} \begin{pmatrix} X_1(n) \\ X_2(n) \\ \vdots \\ X_S(n) \end{pmatrix} \end{cases}$$

FIG.23

IMAGE WRITING POSITION CORRECTION μm
(MAIN SCAN DIRECTION)

| EDGE SNSR OUTPUTd mm | CAM PHASE θ deg | | | | | | | | | | | | | | | | | | |
|---|---|---|---|---|---|---|---|---|---|---|---|---|---|---|---|---|---|---|---|
| | -90 | -80 | -70 | -60 | -50 | -40 | -30 | -20 | -10 | 0 | 10 | 20 | 30 | 40 | 50 | 60 | 70 | 80 | 90 |
| -2 | -25 | -20 | -15 | -10 | -5 | 0 | 5 | 10 | 15 | 20 | 25 | 30 | 35 | 40 | 45 | 50 | 55 | 60 | 65 |
| -1.5 | -30 | -25 | -20 | -15 | -10 | -5 | 0 | 5 | 10 | 15 | 20 | 25 | 30 | 35 | 40 | 45 | 50 | 55 | 60 |
| -1 | -35 | -30 | -25 | -20 | -15 | -10 | -5 | 0 | 5 | 10 | 15 | 20 | 25 | 30 | 35 | 40 | 45 | 50 | 55 |
| -0.5 | -40 | -35 | -30 | -25 | -20 | -15 | -10 | -5 | 0 | 5 | 10 | 15 | 20 | 25 | 30 | 35 | 40 | 45 | 50 |
| 0 | -45 | -40 | -35 | -30 | -25 | -20 | -15 | -10 | -5 | 0 | 5 | 10 | 15 | 20 | 25 | 30 | 35 | 40 | 45 |
| 0.5 | -50 | -45 | -40 | -35 | -30 | -25 | -20 | -15 | -10 | -5 | 0 | 5 | 10 | 15 | 20 | 25 | 30 | 35 | 40 |
| 1 | -55 | -50 | -45 | -40 | -35 | -30 | -25 | -20 | -15 | -10 | -5 | 0 | 5 | 10 | 15 | 20 | 25 | 30 | 35 |
| 1.5 | -60 | -55 | -50 | -45 | -40 | -35 | -30 | -25 | -20 | -15 | -10 | -5 | 0 | 5 | 10 | 15 | 20 | 25 | 30 |
| 2 | -65 | -60 | -55 | -50 | -45 | -40 | -35 | -30 | -25 | -20 | -15 | -10 | -5 | 0 | 5 | 10 | 15 | 20 | 25 |

FIG.30

IMAGE FORMING APPARATUS HAVING STRETCHING ROLLER CORRECTION

This application is a divisional of U.S. patent application Ser. No. 12/903,427, filed Oct. 13, 2010.

FIELD OF THE INVENTION AND RELATED ART

The present invention relates to an image forming apparatus for forming a full-color image such as a printer or copying machine which is provided with an endless belt such as a transfer belt or a feeding belt for feeding a recording material and in which a plurality of toner images are transferred from an image bearing member onto the recording material or onto a transfer belt.

Recently, a so-called tandem structure is widely used because of the increasing image forming speed, in which image bearing members are arranged along an endless transfer belt or recording material feeding belt, the image formation processes for the image bearing members are concurrently performed. For example, a typical example of such a belt is an intermediary transfer belt in a full-color image forming apparatus. In this example, the color toner images are superposingly transferred onto the intermediary transfer belt sequentially, and all the color images are transferred onto the recording material all together. The endless belt such as the intermediary transfer belt used with such a structure is stretched by a plurality of rollers and is rotated.

It is known that the endless belt stretched by the plurality of rollers offsets toward a lateral end during traveling depending on outer diameter accuracy of the roller and/or alignment accuracy between the rollers. In other words, the endless belt shifts in widthwise direction (the direction perpendicular to the travelling direction and parallel to the endless belt surface). To solve such a problem, the following structures are known. In an example, one of the rollers stretching the endless belt is used as a steering roller, an orientation of axis of which is controllable by an actuator such as a motor. The amount and direction of steering of the steering roller are predetermined, and the steering is actuated in response to the output of a sensor for detecting the offset, to the limit, of the belt, or are determined on the basis of the information of the belt position detected by the belt position sensor for detecting the position of the endless belt with respect to the widthwise direction.

In such as belt control by the steering roller, the offset to the limit can be prevented, but it is likely that such a steering control causes a color misregistration or image deformation in the main scanning direction.

Under the circumstances, it has been proposed that an image formation position relative to the image bearing member is shifted on the basis of a result of detections of a belt position sensor for detecting the position of the endless belt with respect to the widthwise directions (Japanese Laid-open Patent Application Hei 3-28816).

On the other hand, a recently image forming apparatus is mostly provided with an image writing position correcting mode for compensating the change, attributable to the temperature rise or the like in the apparatus, of the average position for each color image. In the image writing position correcting mode, a position of a test image for each color is measured by a position detecting means for detecting the position of the image carried on the endless belt (Japanese Laid-open Patent Application 2009-25626).

Thus, in the image writing position correcting mode in which the test image is formed, and is actually transferred onto the belt, and then the position detection is carried out, and the image writing position is corrected. However, with the structure in which the belt is steered, the moving direction of a mass point (given point) of the belt changes depending on the position of the belt in the widthwise direction. Therefore, in the conventional image writing position correcting mode, the color registration accuracy may be insufficient when the moving direction of the mass point at the time of image position detection during the operation of the image writing position correcting mode and the moving direction of the mass point at the time of formation of the image on the recording material

SUMMARY OF THE INVENTION

Accordingly, it is an object of the present invention to provide an image forming apparatus in which a correction accuracy against the change in the average position for each color image due to the temperature rise or the like in the apparatus is improved.

It is another object of the present invention to provide an image forming apparatus comprising a rotatable belt; a first image bearing member; first image forming means for forming an electrostatic latent image and a toner image on said first image bearing member; a second image bearing member disposed downstream of said first image bearing member with respect to a rotational direction of said belt; second image forming means for forming an electrostatic latent image and a toner image on said second image bearing member; transferring means for transferring, onto a belt or onto a recording material carried on said belt, the toner image formed on said first image bearing member and a toner image formed on said second image bearing member; feeding direction calculating means for calculating a moving direction of a predetermined point on said belt; an executing portion for executing an operation in a correcting mode in which a positional relation between an adjustment toner image transferred onto said belt from said first image bearing member and adjustment toner image transferred onto said belt from said second image bearing member is detected, and a writing starting position of the electrostatic latent image to be formed on at least one of said image bearing members on the basis of a result of the detection; and changing means for changing the writing starting position determined by said correcting mode on the basis of a difference between the moving direction calculated by said feeding direction calculating means during the operation in the correcting mode and the moving direction calculated by said feeding direction calculating means during image formation based on an inputted image formation signal.

These and other objects, features, and advantages of the present invention will become more apparent upon consideration of the following description of the preferred embodiments of the present invention, taken in conjunction with the accompanying drawings.

Part (a) of FIG. 23 is an example of a calculation formula for an image writing position correction value according to embodiment 1.

Part (b) of FIG. 23 is an example of a calculation formula for an image writing position correction value according to embodiment 1.

Figure 24:
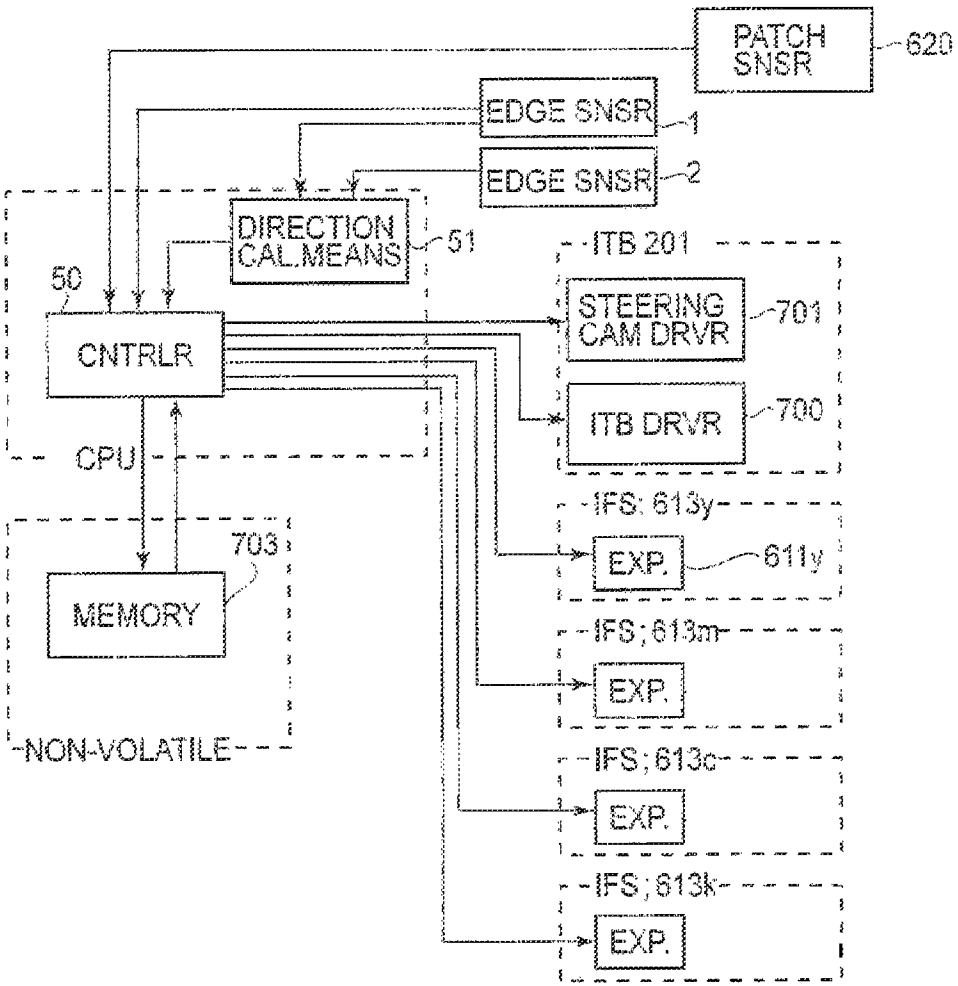

FIG. 24 is a block diagram illustrating an operation in Embodiment 2.

Figure 25:
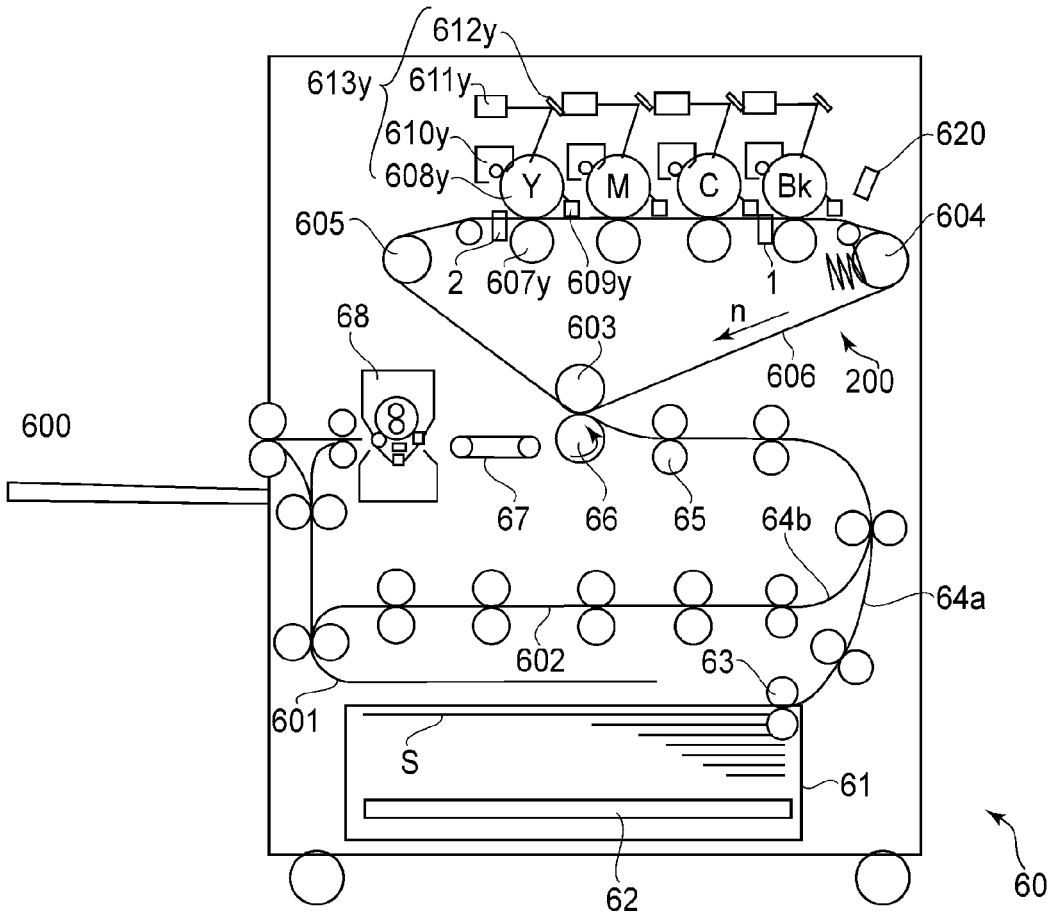

FIG. 25 is a schematic sectional view of the image forming apparatus according to embodiment 2 of the present invention.

Figure 26:
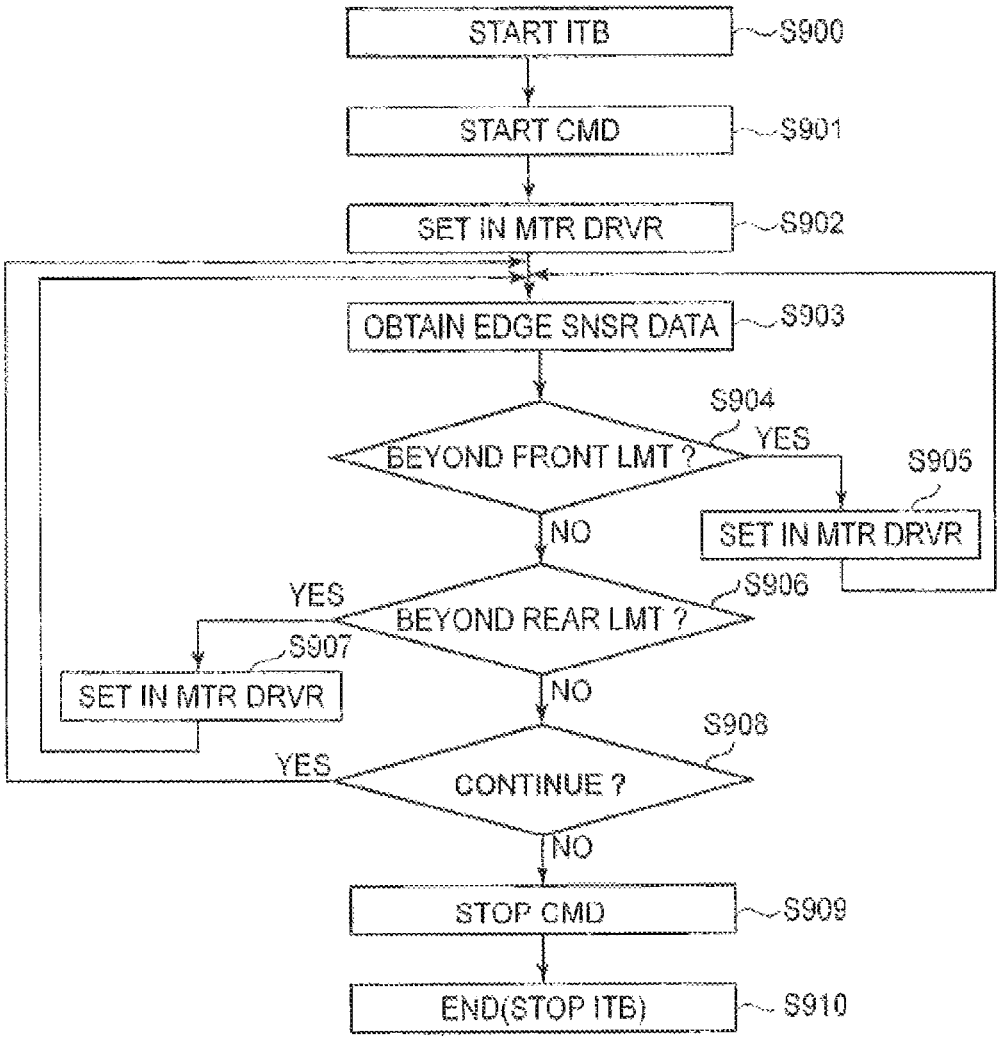

FIG. 26 is a flowchart illustrating a steering control in Embodiment 2.

Figure 27:
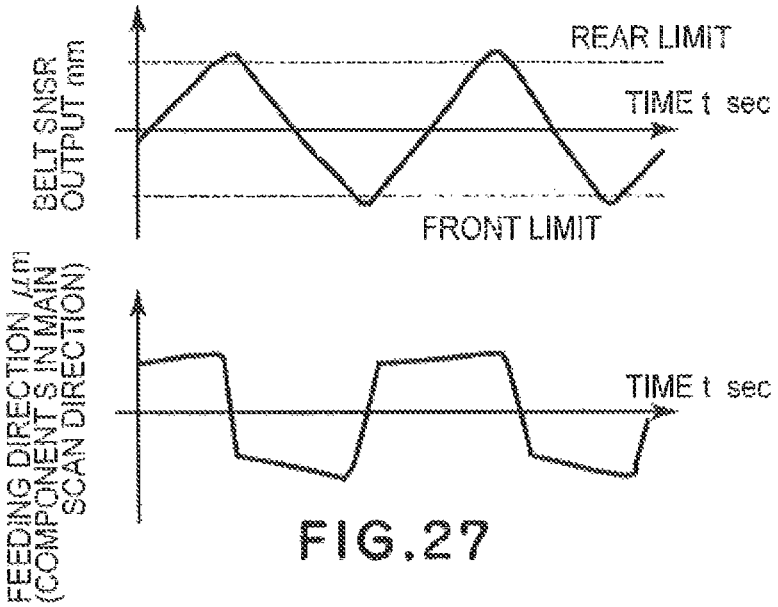

FIG. 27 illustrates a belt edge sensor output and a change of the belt feeding direction in embodiment.

Figure 28:
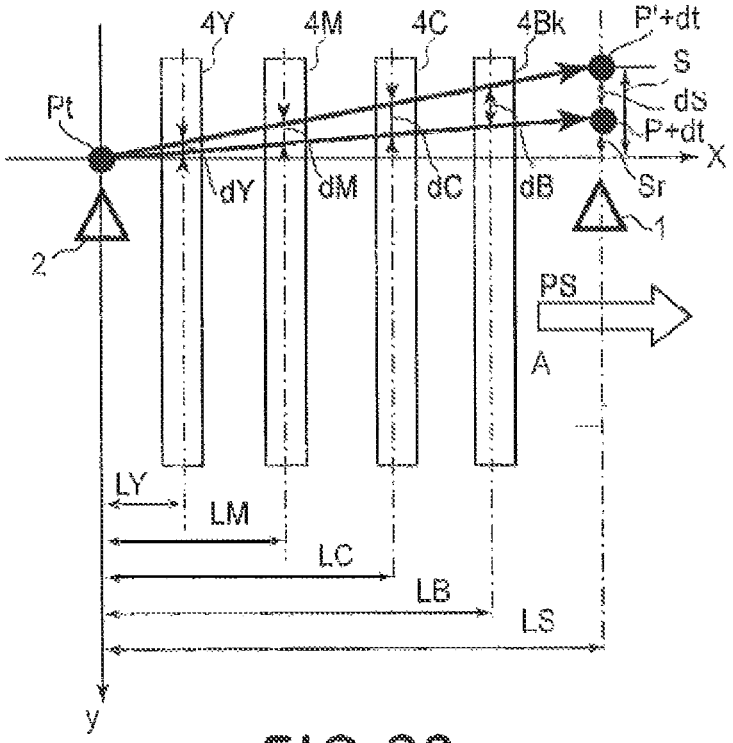

FIG. 28 illustrates a relation between the belt feeding direction and the image writing position correction value in embodiment 2.

Figure 29:
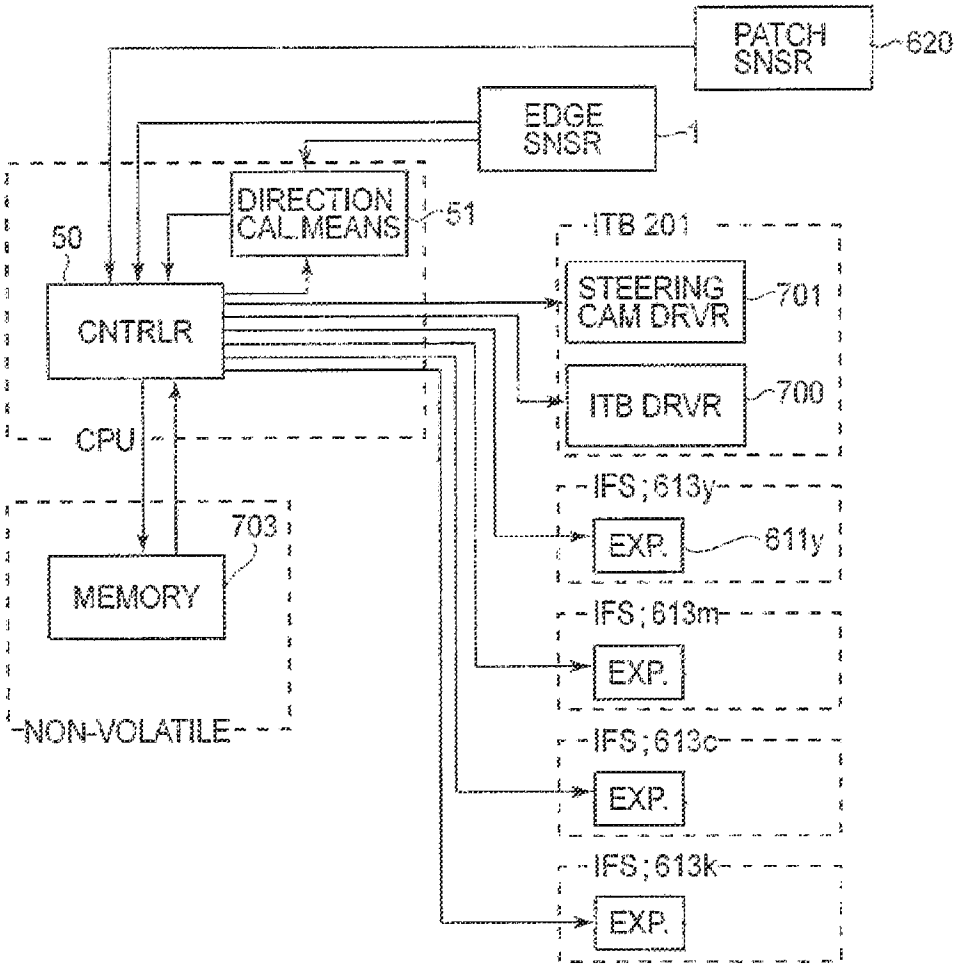

FIG. 29 is a block diagram illustrating an operation in Embodiment 3.

FIG. 30 shows an example of an image writing position correction value calculating table in embodiment 3.

Figure 31:
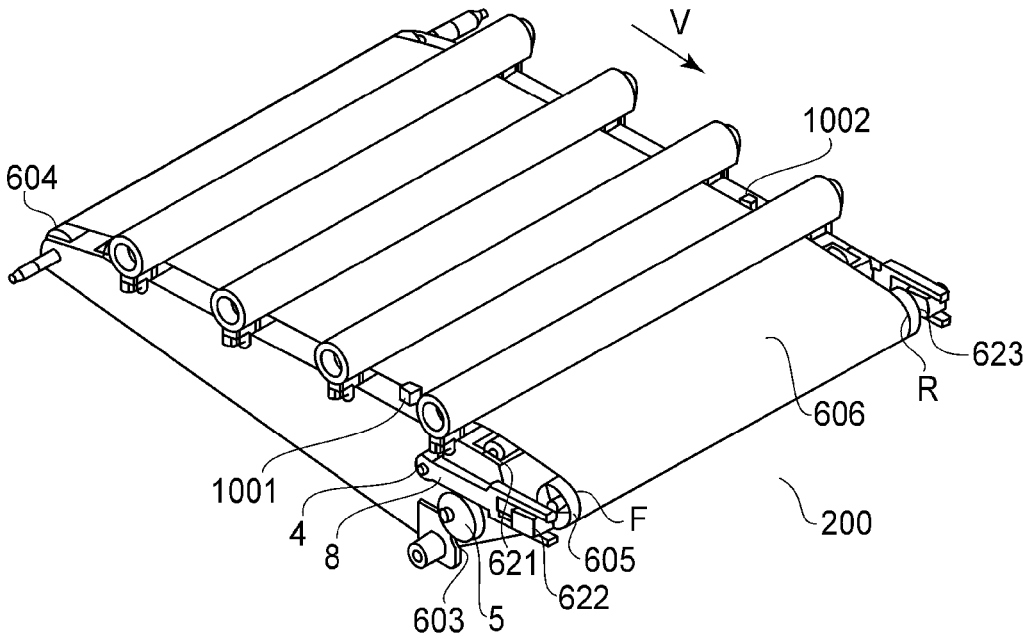

FIG. 31 illustrates an intermediary transfer belt unit employed in Embodiment 4.

Figure 32:
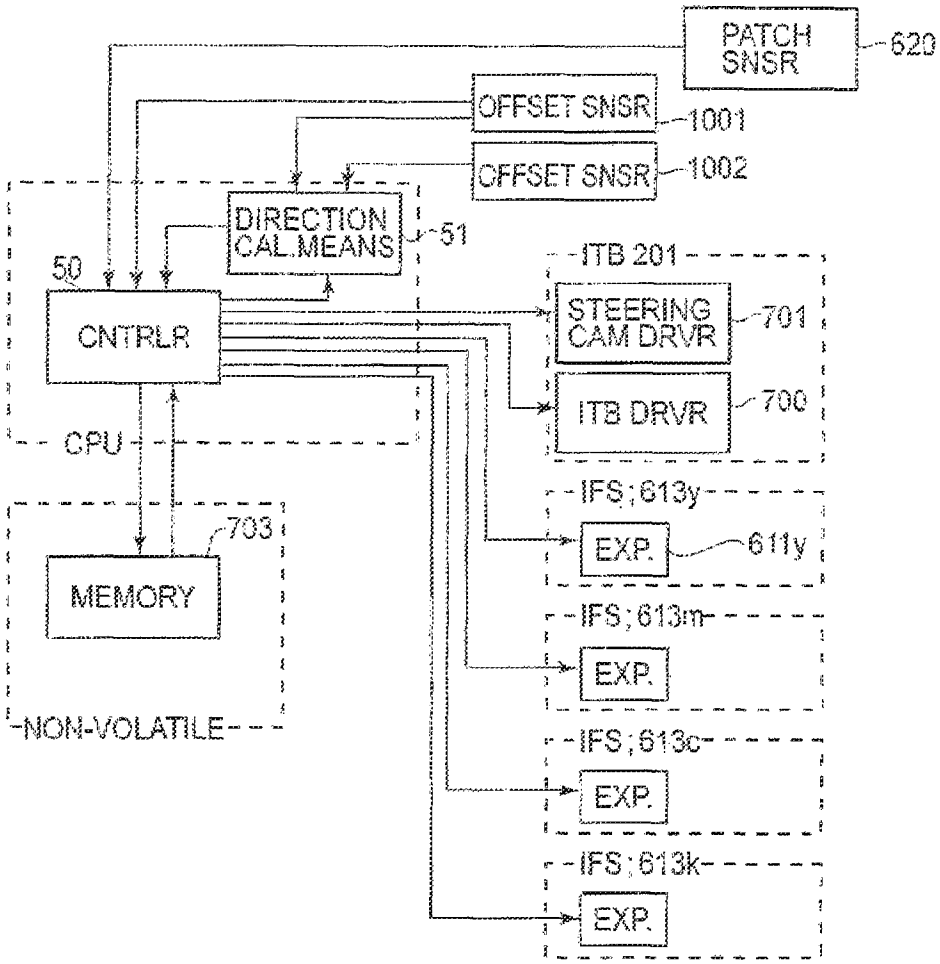

FIG. 32 is a block diagram illustrating an operation in embodiment 4.

DESCRIPTION OF THE PREFERRED EMBODIMENTS

Embodiment 1

<Image Forming Apparatus>

Figure 22:
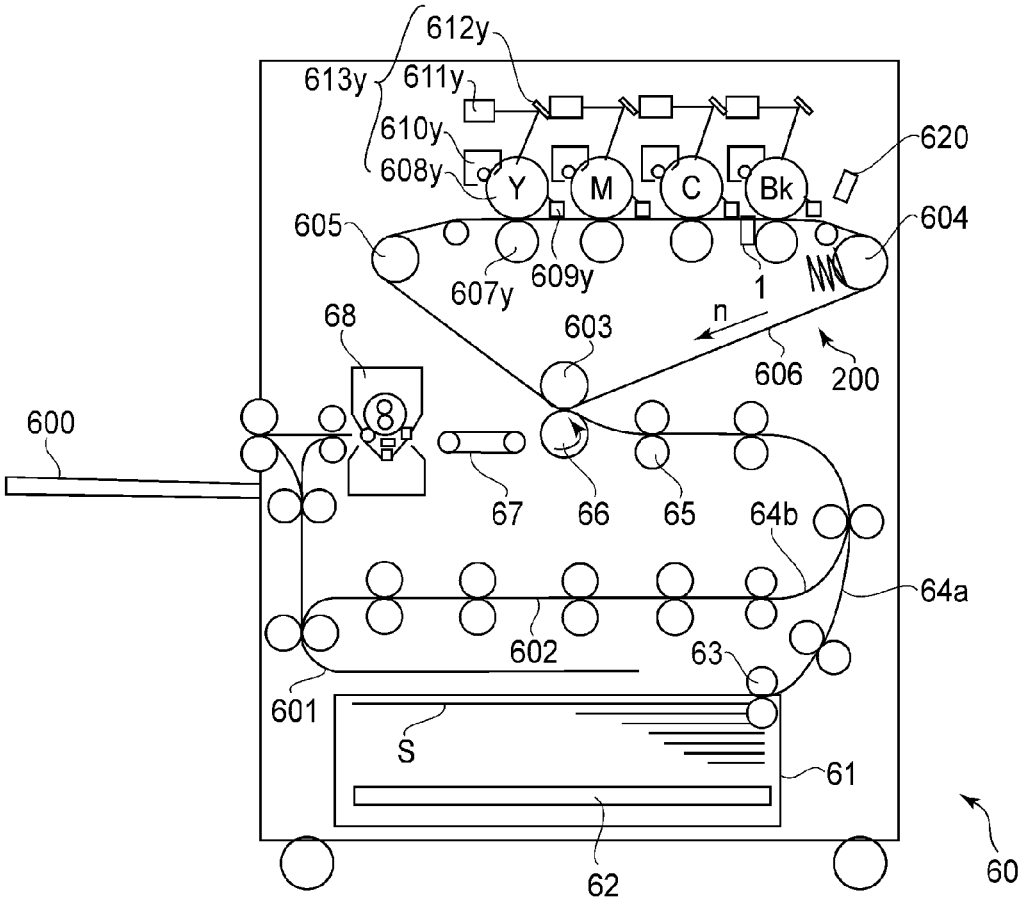
FIG. 22 is a schematic sectional view of the image forming apparatus according to embodiment 1 of the present invention.

An image forming apparatus according to an embodiment of the present invention will be described. Referring first to FIG. 22, operations of the image forming apparatus will be described. An image forming apparatus 60 shown in FIG. 22 is a color image forming apparatus using an electrophotographic type. The image forming apparatus 60, a sectional view of which is shown therein is a so-called intermediary transfer and tandem type image forming apparatus in which four color image forming stations are arranged along the intermediary transfer belt. This type is dominant recently in view of the usability which thick sheets and productivity are good.

<Feeding Process For Recording Material>

Recording materials S are accommodated on a lifting device 62 in a recording material accommodation case, and are fed out by a sheet feeding means 63 in timed relation with image formation. Sheet feeding means 63 may be of a type using friction separation by a sheet feeding roller or the like or a type using separation and attraction by air, and in the embodiment of FIG. 22, the latter is employed. The recording material S delivered by the sheet feeding means 63 passes on a feeding path 64*a* to a registration device 65. The registration device 65 carries out an inclination correction and/or a timing correction, and then, the recording material S is fed to a secondary transfer portion. The secondary transfer portion is a toner image transferring nip provided by the roller 603 in the secondary transfer device and a roller 66 outside the secondary transfer device which are opposed to each other, and is effective to transfer the toner image onto the recording material S by applications of a predetermined pressure and a predetermined electrostatic bias.

<Image Formation Process>

Concurrently with the recording material feeding process to the secondary transfer portion, a formation process is carried out. An image forming station 613*y* comprises a photosensitive member 608*y* (image bearing member), an exposure device 611*y*, a developing device 610*y*, a primary transferring device 607*y*, a photosensitive member cleaner 609*y* and the like. A surface of the photosensitive member 608*y* is uniformly charged by the charging means, and is exposed to the image light of the image information signal during rotation in the direction indicated by an arrow n in the Figure by the exposure device 611*y*, and a latent image is formed using diffraction means 612*y*. The electrostatic latent image formed on the photosensitive member 608*y* is visualized into a toner image on the photosensitive member by development with the toner by the developing device 610*y*. Thereafter, the toner image is transferred onto the intermediary transfer belt 606 which is a travelling endless belt by the primary transferring device 607*y* with the predetermined pressure and electrostatic bias. A small amount of untransferred toner remaining on the photosensitive member 608*y* is removed and collected by the photosensitive member cleaner 609*y*, so that the photosensitive member 608*y* is prepared for the next image forming operation. The image forming station 613*y* described above is an image forming station for forming a yellow (Y) image. In this embodiment (FIG. 22), the apparatus further comprises an image forming station 613*m* for forming a magenta (M)

image, an image forming station 613*c* for forming a cyan (C) image and an image forming station 613*k* for forming a black (Bk) image. The number of colors is not limited to four, and the order of the arrangement thereof is not limited to that of this embodiment.

A description will be made as to the intermediary transfer belt unit 200 which is a belt feeding means for feeding the endless transfer belt. The intermediary transfer belt 606 is supported and stretched by inner surface holding members including a driving roller 604, a tension roller 605 and an inner roller 603 (in the secondary transfer device) or the like a and is rotated in the direction indicated by an arrow n in the Figure. The image forming processes of the Y, M, C and Bk image forming apparatuses 613 which are performed concurrently are executed with such a timed relation as to superimpose the image on the previous toner image transferred onto the intermediary transfer belt 606 (primary transfer). As a result, a full-color toner image is formed on the intermediary transfer belt 606 finally, and is fed to the secondary transfer portion.

<Process Following Secondary Transfer>

In the secondary transfer portion, the full-color toner image is secondary-transferred onto the recording material S fed by the above-described process. Thereafter, the recording material S is fed to a fixing device 68 by a feeding portion 67. The fixing device 68 fuses and fixes the toner image on the recording material S by a predetermined pressure applied by a roller or a belt or the like and heat applied by heat source such as heater or the like. The recording material S having the fixed image is discharged to a sheet discharge tray 600 or is refed to a reverse feeding device 601 by a branch feeding device. In the case of duplex image formation (images on both sides), the recording material S fed to the reverse feeding device 601 is refed into the duplex print feeding device 602 after switchback operation with shift of the leading end to the trailing end. In timed relation with the recording material of the subsequent job fed from the sheet feeding apparatus 61, the sheet is fed to the secondary transfer portion through a refeeding path 64*b* merging with the feeding unit 64. The image forming process for the back side (second side) is similar to that for the first side, and therefore, the detailed description thereof is omitted for simplicity.

<Steering Structure For Intermediary Transfer Belt>

Figure 7:
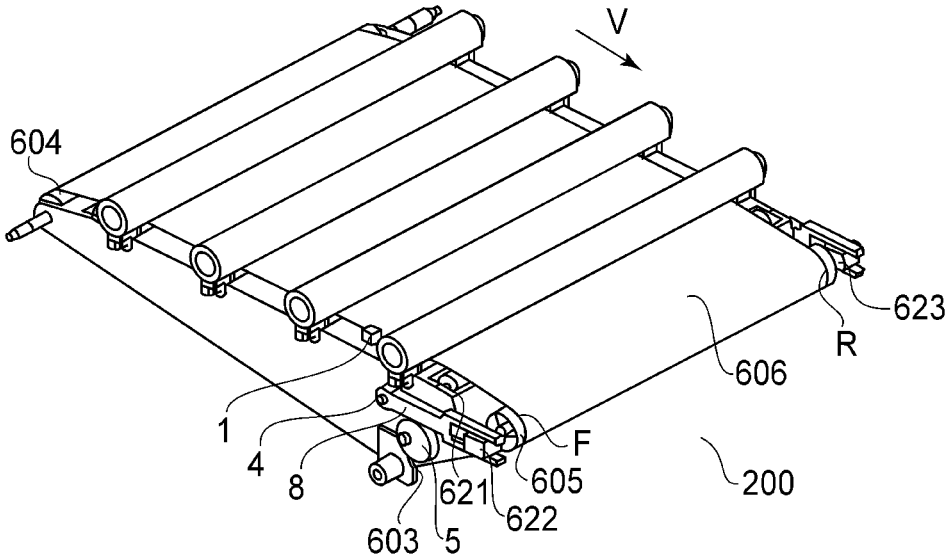
FIG. 7 illustrates an intermediary transfer belt unit employed in the embodiment.
Figure 8:
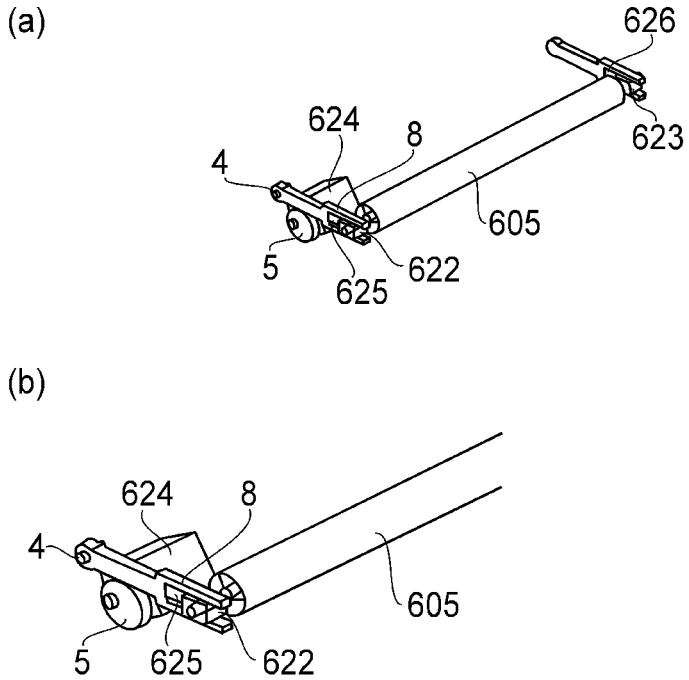
FIG. 8 illustrates a steering mechanism used in the embodiment.
Figure 9:
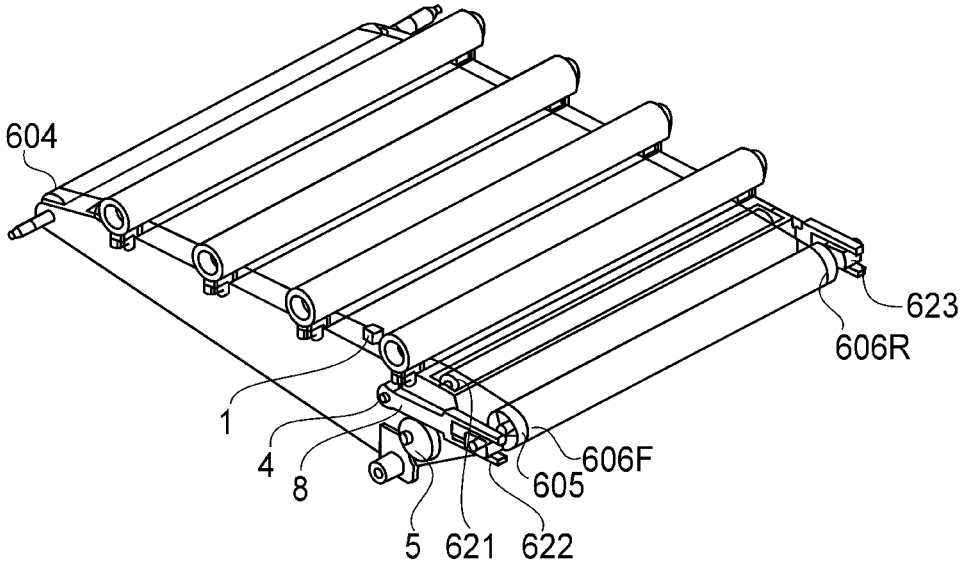
FIG. 9 illustrates a steering operation of the intermediary transfer belt unit in the embodiment.
Figure 10:
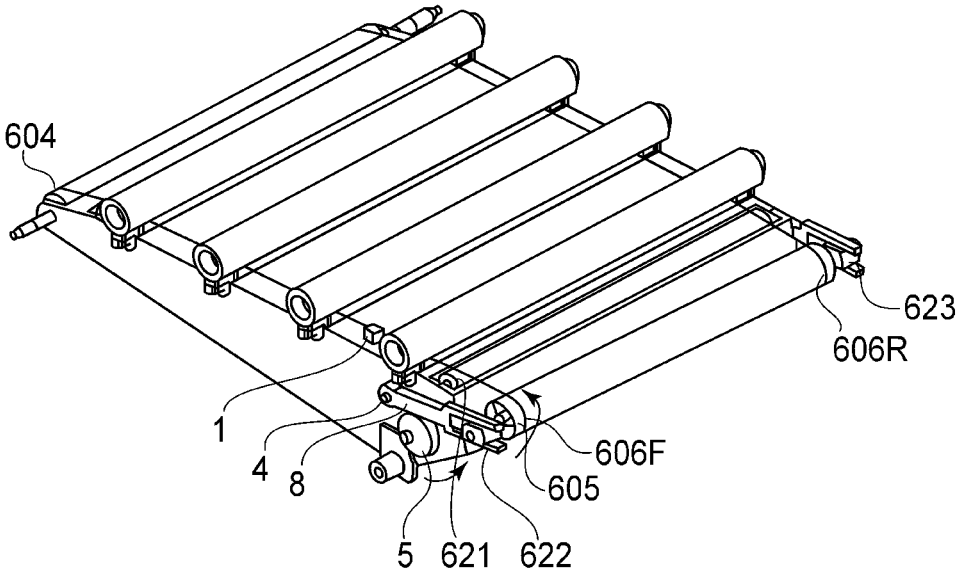
FIG. 10 illustrates a steering operation of the intermediary transfer belt unit in the embodiment.

FIG. 7 is a perspective view illustrating a structure of the intermediary transfer belt unit 200 according to this embodiment, and FIG. 8 is a perspective view illustrating a structure of a steering mechanism 201. The intermediary transfer belt 606 is an endless belt and is supported and stretched by the plurality of rollers including the driving roller 604, the inner roller 603, the idler roller 621, and the steering roller 605. The intermediary transfer belt 606 is driven in the direction indicated by an arrow in the Figure at a feeding speed V. The steering roller 605 is supported by a steering mechanism 201 which is steering roller inclining means for changing substantially in real time a parallelism of the direction crossing with the belt stretching surface relative to another inner surface holding member. The steering roller 605 functions to correct so-called belt offset which is oblique travelling of the belt. In this embodiment, the steering arm 8 clasp one of bearing portions 622, 623 supporting the steering roller 605, and the steering arm 8 receives a moment to the rotational center 4 by urging means such as unshown tension spring to be normally urged to the cam surface of the steering cam 5. The cam phase of the steering cam 5 can be controlled by, for example, being mounted on the shaft of the steering motor 624 of FIG. 8, by which the steering arm 8 and the steering roller 605 can swing as shown in FIG. 9 through FIG. 10 (when the steering cam 5 rotates in the direction of an arrow in FIG. 10, the arm 8 moves in the direction of an arrow in the Figure, and when it rotates in the opposite direction, the arm swings in the opposite direction). In FIG. 9 et seqq., only the front end F and the rear side end R of the intermediary transfer belt 606 are shown for better illustration. With the steering structure, the bearing portion 622 is movable relative to the fixed side bearing portion 623 of the steering roller 605, by which the axis alignment is destroyed. The variable range of the axis alignment is determined by a cam profile of the steering cam 5 and a distance from the rotational center 4 to the steering roller 605, and is selected properly in consideration of the maximum amount of steering required for correction of the belt offset.

The intermediary transfer belt is to be stretched by a predetermined tension, and making this embodiment, the steering roller 605 is urged in the direction crossing with the stretching surface of the intermediary transfer belt 606 by urging springs 625, 626, and therefore, it functions also as a tension roller. The idler roller 621 is disposed between the photosensitive members 608Y-608Bk and the steering roller 605, by which the belt surface of the primary transfer portion (nip formed by the nips provided by the photosensitive members 608Y-608Bk) does not significantly change due to the steering operation. The intermediary transfer belt unit 200 shown in FIG. 7 is provided with a belt edge sensor 1 which is belt position detecting means for detecting the position of the belt in the direction crossing in the travelling direction of the belt. The belt edge sensor 1 detects an amount of tilting of the arm type contact element contacting the belt end for example by a gap sensor, and the detected amount is converted to the movement distance of the end (that is, the amount of the belt offset.

<Steering Control>

Figure 1:
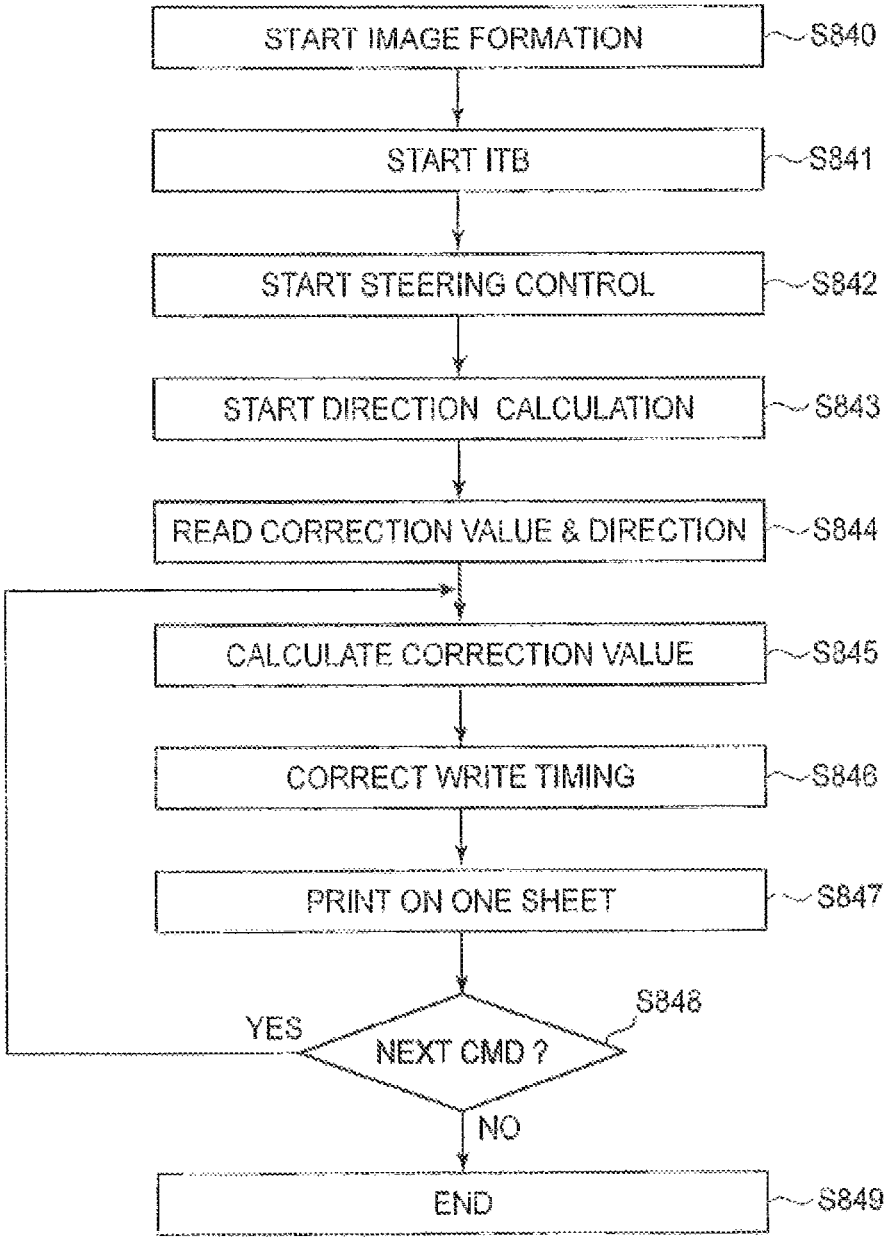
FIG. 1 is a flowchart illustrating a color registration control in the main scanning direction during image forming operation according to embodiment 1.
Figure 2:
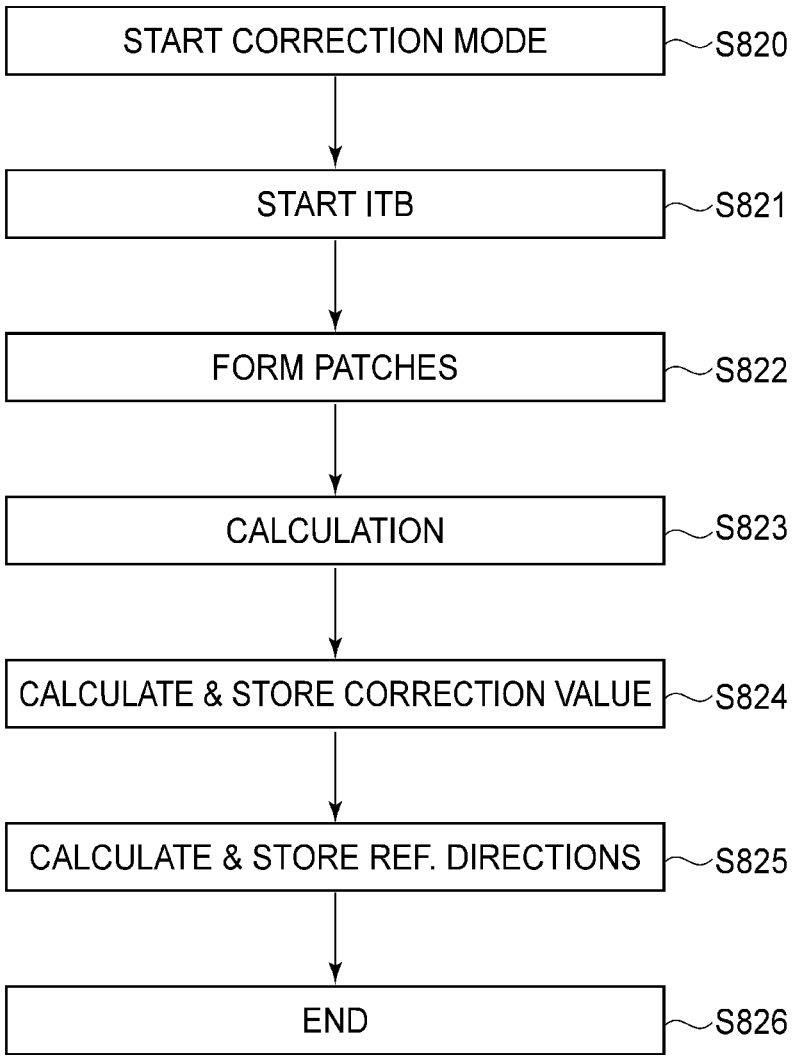
FIG. 2 is a flowchart illustrating an image writing correcting mode in the embodiment.
Figure 3:
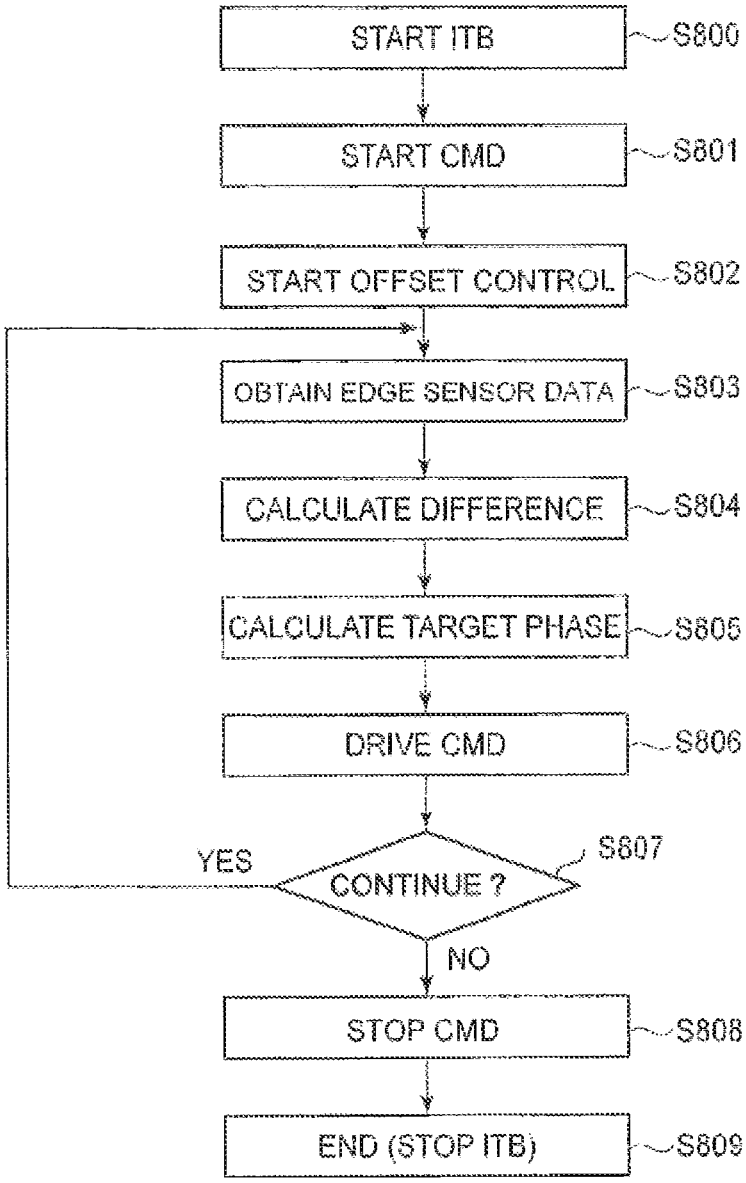
FIG. 3 is a flowchart illustrating a steering control in the embodiment.
Figure 4:
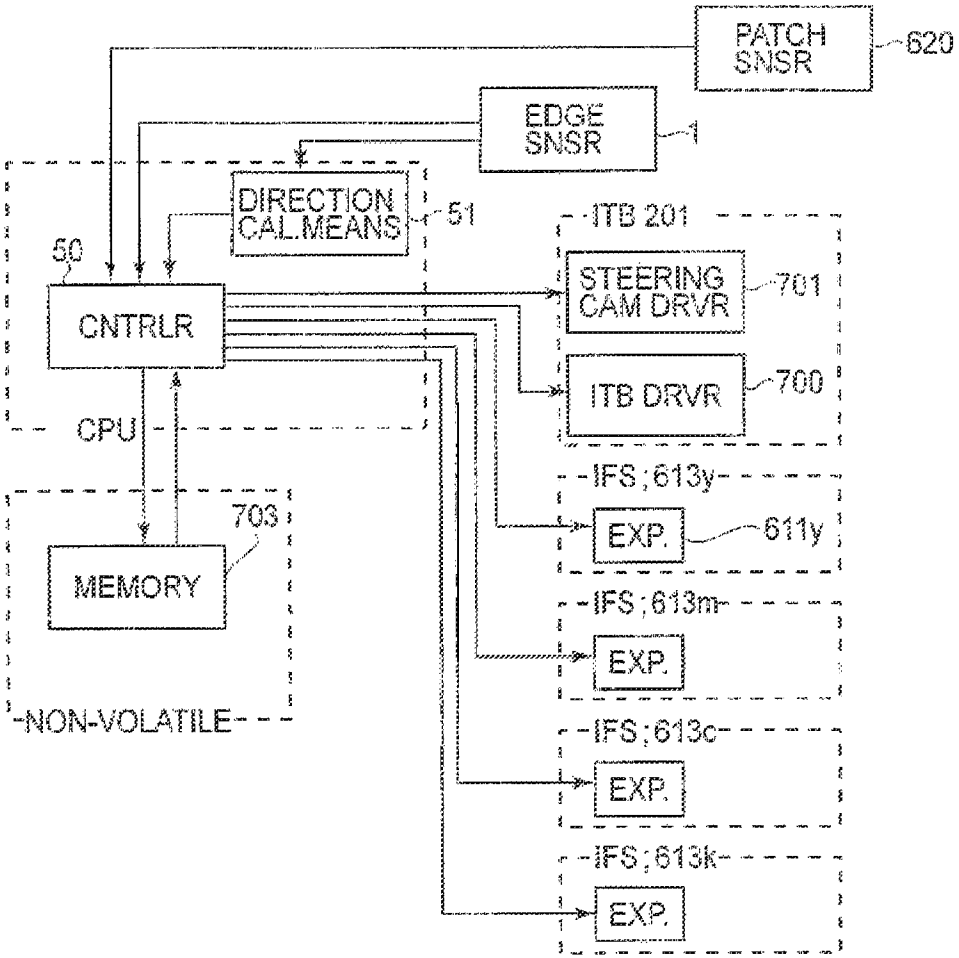
FIG. 4 is a block diagram illustrating an operation in the embodiment.

FIG. 1 shows a color registration control in the main scanning direction, FIG. 2 shows an image writing position correcting mode, FIG. 3 is a flowchart of the steering control by the steering mechanism 201 for correcting the belt offset, and FIG. 4 is a block diagram, used in this embodiment.

Referring first to FIG. 3, the steering control of the steering mechanism 201 will be described. When the start of the intermediary transfer belt is instructed in the image formation mode or various image adjusting modes (S800), a drive start command is sent to a belt drive motor driver 700 from the controller 50 of FIG. 4 (S801). Then, the belt offset control is started by the steering mechanism 201 (S802). When the belt offset control starts, the controller 50 obtains belt edge positional data from the belt edge sensor 1 (S803), and calculates a difference from a preset target edge position (S804). The controller 50 calculates a target phase of the steering cam 5 in accordance with a predetermined PID control, using the result of the plurality of detections of the belt edge sensor 1 (belt position detecting means) (S805). In response to the target phase, a drive command is sent to a steering cam drive motor driver 701 (S806). The operations from S803 to S806 are repeated normally at predetermined control intervals during driving operation of the intermediary transfer belt (S807). When the image formation or the image adjusting mode operations are completed, a drive and stop instructions is sent to the belt drive motor driver (S808), and the intermediary transfer belt stops (S809). In this manner, as long as the intermediary transfer belt is driven, the offset of the intermediary transfer belt 606 is prevented.

<Image Writing Position Correcting Mode>

Figure 5:
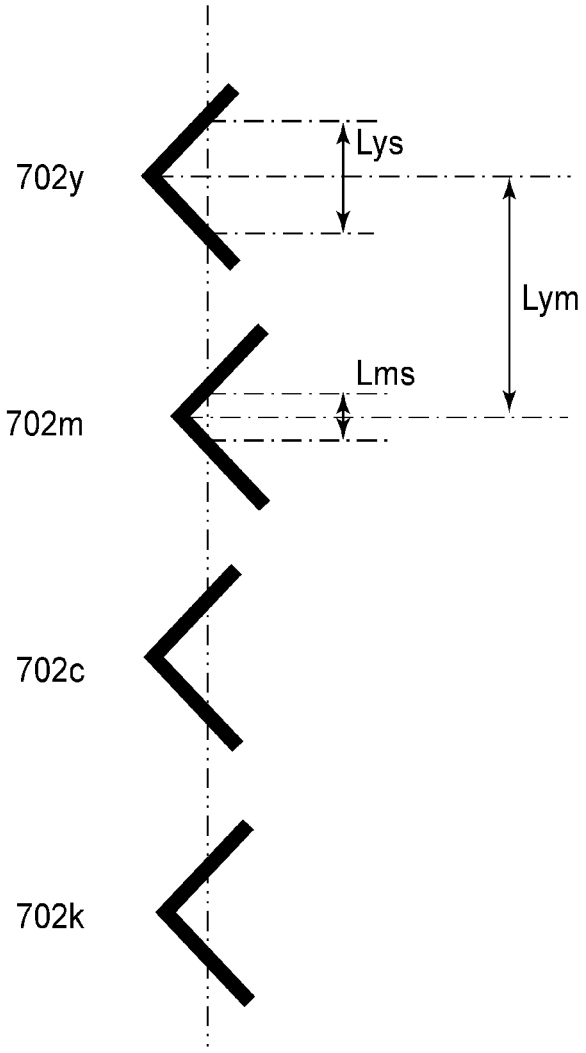
FIG. 5 illustrates an ordinary registration patch image.
Figure 6:
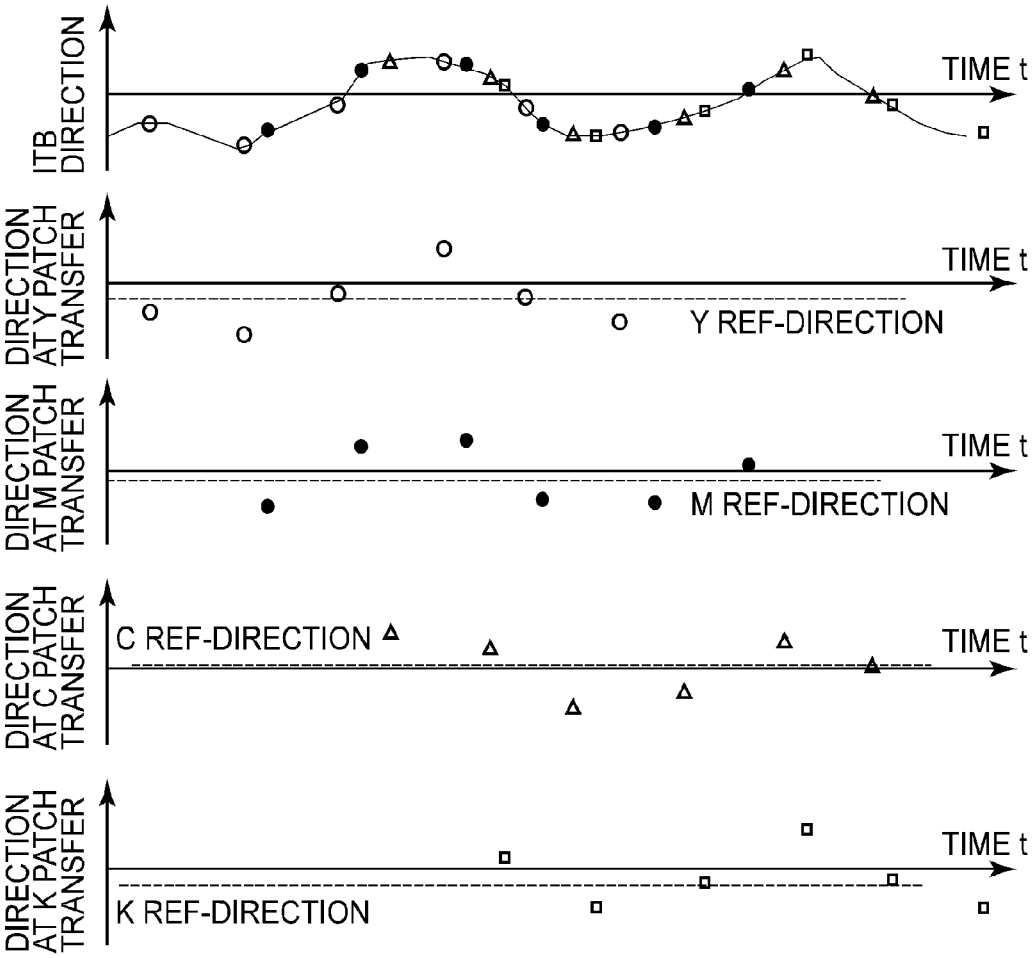
FIG. 6 illustrates a belt feeding direction during an operation in the image writing correcting mode in embodiment 1.

Subsequently, a test image is printed on the belt, and the position of the test image on the belt is detected by an image position detecting means for detecting the position thereof on the belt. On the basis of the result of detection, the image writing position on the image bearing member is corrected by the operation in the image writing position correcting mode, which will be described referring to FIG. 2. The controller 50 in FIG. 4 has a function as an executing portion for executing the image writing position correcting mode. The controller has a function of changing means for changing the writing starting position determined in the correcting mode on the basis of a difference between a moving direction calculated by feeding direction calculating means in the execution of the correcting mode and the moving direction calculated by a feeding direction calculating means in the image formation based on the image formation signal, as will be described hereinafter. The image writing position correcting mode (correcting mode) is executed in response to the user's instructions, or at predetermined timing set in the apparatus, such as at the time of image forming apparatus installation, at each of predetermined print number, and is effective to correct image writing positional deviation due to the manufacturing error of the image forming apparatus and to correct the change with time in the image writing position due to temperature rise or the like in the machine. In the image writing position correcting mode of this example, a reference feeding direction for each color to be used in belt-causing-color-misregistration correcting operation in the image forming operation which will be described hereinafter is set, too. When the start of the image writing position correcting mode is instructed (S820), the intermediary transfer belt drive starts (S821). During the intermediary transfer belt being driven, the steering control of FIG. 3 is normally. Subsequently, the test images in the form of registration patches starts to be formed by the image portions 613*y*, 613*m*, 613*c*, 613*k* under the control of the controller 50 (S822). An example of the registration patch is shown in FIG. 5, wherein images are formed continuously a plurality of times on the intermediary transfer belt 606. The detection of the position, on the belt, of the image is effected by reading the registration patches by the registration patch sensor 620 which is an on-belt-position detecting means (position detecting means) shown in FIG. 6. Relative positional relations among the color patches are calculated by the durations in which the images of FIG. 5 pass the registration patch sensor 620. For example, the color registration patch images 702*y*, 702*m*, 702*c*, 702*k* as shown in FIG. 5 passes by the registration patch sensor 620 at the position indicated by the chain lines in FIG. 5, the intervals of the image portions are calculated from the passing times. For example, Lys, Lms of FIG. 5 represent positions of the patches with respect to the main scan direction (the direction perpendicular to the feeding direction of the belt), and as shown in FIG. 5, the relative positional relations of the color patches are calculated from the lengths thereof. From Lym of FIG. 5 which is a relative difference of the averages at two passing portions of the patches, the relative positions of the patches with respect to the sub-scan direction are calculated. In this manner, the relative positional relation among the color images is calculated.

During an image forming operation of the registration patch, the steering control of FIG. 3 is carries out. The feeding direction of the belt (moving direction of a predetermined point on the belt) at this time is calculated by a feeding direction calculating portion 51 which is belt feeding direction calculating means which will be described hereinafter, at predetermined intervals. The controller 50 reads, from the feeding direction calculating portion 51, and stores the belt feeding direction at the time of each registration patch being transferred from the photosensitive member 608 to the intermediary transfer belt 606 (S823).

The registration patches shown in FIG. 5 constitutes a set of patches, and normally, a plurality of such patches is formed and detected. Each sets of the patch images are influenced by various external disturbances, and therefore, there are various small different among the sets of patches, and in view of the fact, the data of the sets are averaged. A series of operations in S823 are repeated until a predetermined number of registration patch data are obtained. After the predetermined number of registration patch data is obtained, the controller 50 averages the relative positional deviation of each image provided by the registration patches, and the image writing position correction value to correct the average positional deviation is calculated (S824). The image writing position correction value may be that for changing the writing position to the downstream drum (M, C, Bk drums in FIG. 22) with respect to the rotational direction of the belt or may be that for changing the writing position to the downstream drum (Y drum in FIG. 22), too. Simultaneously, the belt feeding direction calculated values (the moving direction of the predetermined point) are also averaged, and as shown in, FIG. 6, the reference feeding direction for each color is calculated and stored (S825) and the image writing position correcting mode ends (S826).

<Relation Between Belt Feeding Direction and Color Misregistration>

Referring to FIGS. 11, 12, 13 and 14, a description will be made as to a relation between an amount of steering roller inclination provided by the steering operation and a change in the belt feeding direction (the change of the moving direction of the predetermined point on the belt) and a color misregistration in the main scanning direction, with respect to an ordinary stretching layout.

Figure 11:
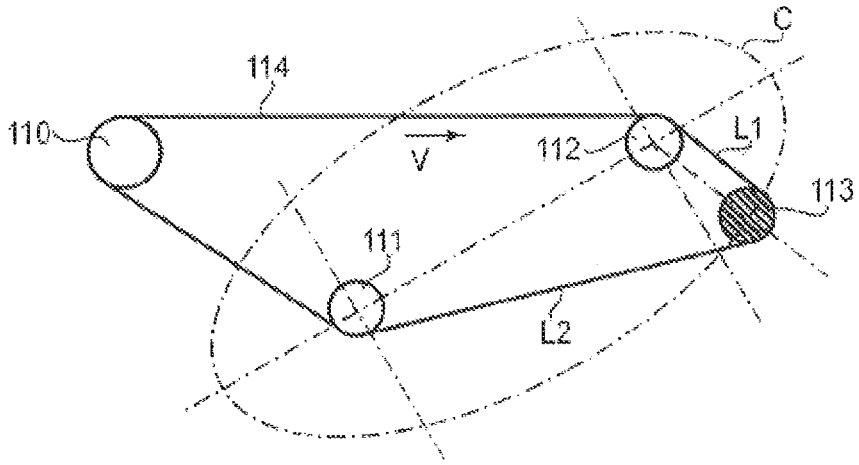
FIG. 11 illustrates an ordinary belt unit in which a relation between the steering operation and the color misregistration is shown.

FIG. 11 shows an ordinary stretching layout of an endless belt 114, and are stretched and extended around four rollers. The roller indicated by hatching lines functions as the steering roller 113, and the other rollers are called stretching rollers 111 and 112, and a driving roller 110. The endless belt 114 has a high Young's modulus, and expansion and contraction thereof is substantially negligible. In the case that the positions of the three rollers except for the steering roller 113 is fixed, the range of the position of the steering roller 113 which the steering roller 113 is capable of take is a range satisfying the condition of L1+L2=constant shown in FIG. 11, that is, on an elliptic orbit having points of focus at the stretching rollers 111 and 112. This is because the elongation of the belt having the high Young's modulus is so small that the constant belt circumferential length in the stretching section is limiting.

Figure 12:
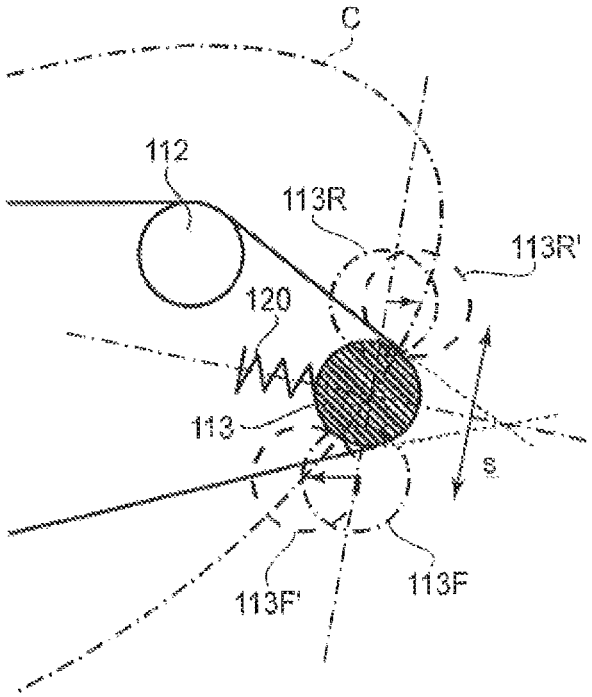
FIG. 12 illustrates an ordinary belt unit in which a relation between the steering operation and the color misregistration is shown.

FIG. 12 illustrates belt offset control, wherein the steering roller 113 changes the axis alignment in the direction of an arrow s in the Figure by an unshown actuator. More particularly, the tendency of the change is such that the leading edge and the trailing edge of the steering roller moves toward the positions shown by 113F and 113R, respectively in FIG. 12 which is a sectional view of the stretching layout. Actually, however, the leading edge and the trailing edge of the steering roller move to the positions 113F' and 113R', respectively because of the confining condition of the above-described elliptic orbit C. The steering roller 113 also functions as the tension roller applying a desired tension to the endless belt 114 by urging means 120 or the like spring, and therefore, the correction is made by the expansion and contraction function of the urging means 120. The change of the axis alignment provided by the correction is the change of the belt feeding direction.

Figure 13:
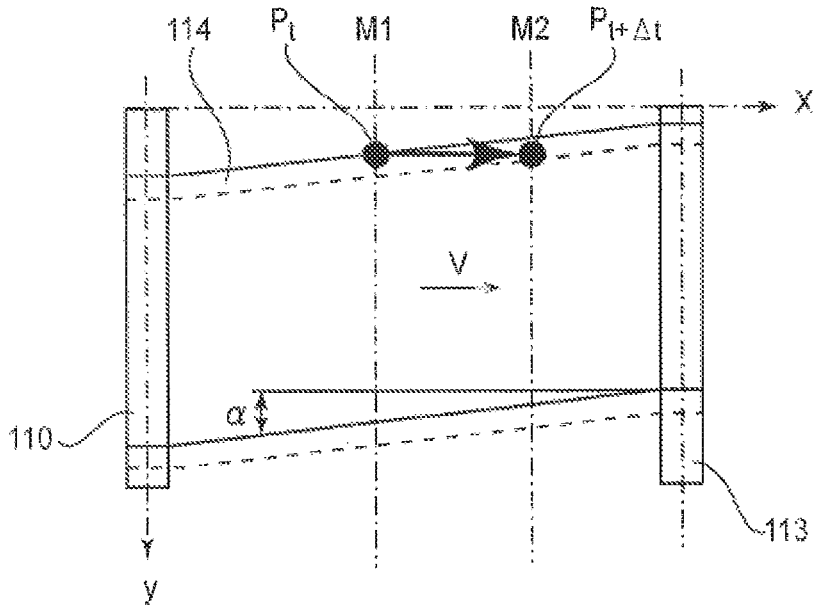
FIG. 13 illustrates an ordinary belt unit in which a relation between the steering operation and the color misregistration is shown.
Figure 14:
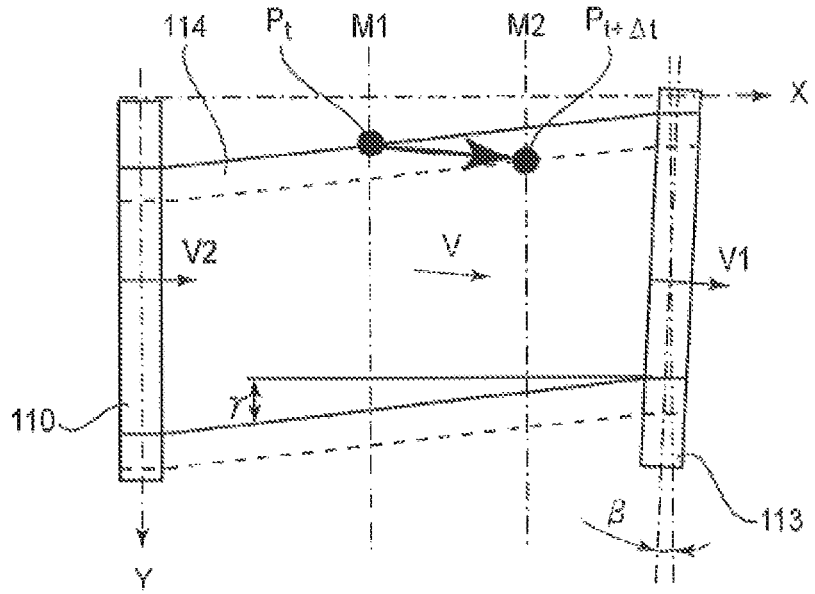
FIG. 14 illustrates an ordinary belt unit in which a relation between the steering operation and the color misregistration is shown.

FIGS. 13 and 14 show a pulling plane of the steering roller 113 and correspond to top views of the stretching layout (FIG.

12). In the Figures, the endless belt 114 is driven in the direction of an arrow V, and the solid lines show the stretching attitude at time t, and the broken lines show the stretching attitude at time t+⊿t. Here, it is supposed that the end position of the endless belt 114 is measured at two measurement points M1 and M2 arranged in the feeding direction (the feeding speed is takes as the distance between points M1 and M2 per time ⊿t). FIG. 13 is based on the assumption that the steering roller 113 inclines in the direction of S (FIG. 12) only, and the endless belt 114 travels in the direction of X with inclination α. At this time, the end position deviates in the Y direction at the measurement points M1 and M2, namely, the belt offsets. However, as a mass point (given point) Pt on the pulling surface at time t is traced, it is at Pt+⊿t aligned in the X direction at the time of t+⊿t, and therefore, the mass point per se does not displace in the Y direction. The displacement of the mass point in the Y direction is the color misregistration. In this case, no color misregistration in the main scanning direction is caused by the steering operation.

Actually, however, the steering roller 113 inclines in the S direction, and simultaneously corrected to the elliptic locus, and therefore, two changes occur in the stretching attitude of inclination α and the feeding direction of inclination β as shown in FIG. 14. As a result, in the duration from t to t+⊿t, not only the displacement in the Y direction at the measurement points M1 and M2, that is, the belt offset, but also the displacement in the Y direction of the mass point Pt per se occur. This is the change of the belt feeding direction and the color misregistration in the main scanning direction, resulting from the steering operation.

As shown in FIG. 14, when feeding direction vectors V1, V2 of the downstream roller 110 and the upstream roller 113 for one stretching surface become different as described above, the feeding direction of the mass point of the stretching surface is controlled by the vector V1.

$$V=V1 \quad (1).$$

The reason will be described.

<Inclination of Roller and Feeding Direction of Belt>

Figure 15:
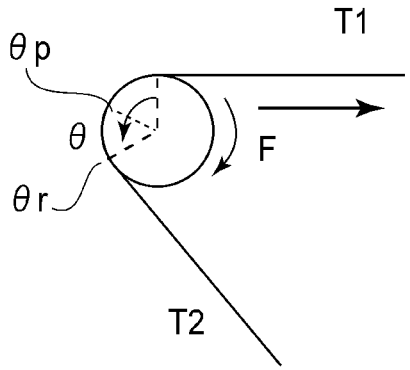
FIG. 15 illustrates an ordinary belt unit in which a relation between the steering operation and the color misregistration is shown.

The confining force to the belt by a roller stretching the belt is expressed by an Euler's formula as follows. As shown in FIG. 15, the tension T1 of the belt in the contact ending side, the tension T2 in the contact starting side, and a force F on the peripheral surface generated by the roller driving force or load, the following results from the force balance when the belt and the roller rotates integrally:

$$T1+F=T2 \quad (2).$$

(F is positive when roller drives, and is negative when roller receives load).

The belt tension T' in angle θ which is a contact angle, that is, the angle from the contact starting point to the contact ending point is expressed by the Euler's formula:

$$T'==T1*e^{\mu\theta} \quad (3)$$

where μ is a static friction coefficient between the belt and the roller.

When F is negative, $$T'=T1*e^{-\mu\theta} \quad (4)$$

When the contact angle between the roller and the belt is θr, the condition under which the belt and the roller rotate integrally without slip is:

$$T1*e^{\mu\theta r}>T2(F \text{ is positive}) \quad (5)$$

Or $$T1*e^{-\mu\theta r}<T2(F \text{ is negative}) \quad (6)$$

Figure 16:
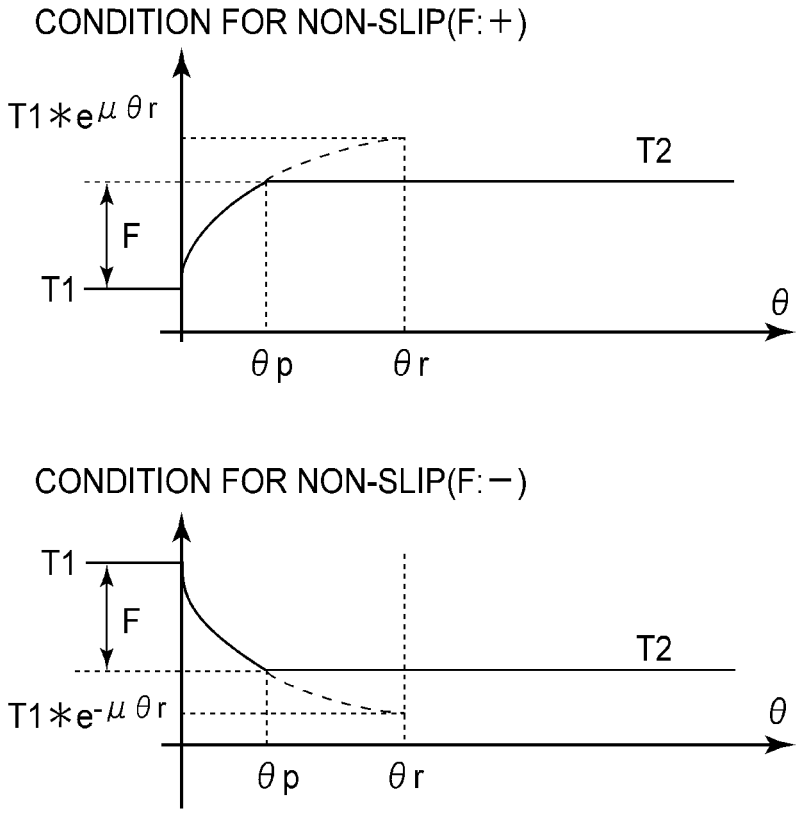
FIG. 16 illustrates an ordinary belt unit in which a relation between the steering operation and the color misregistration is shown.

The relation is shown in FIG. 16. In FIG. 16, when an angle at which the tension of the belt contacted to the roller is T2 is θp, the tension changes in accordance with the Euler's formula within the range of 0 to θp degrees, and in the case that the friction coefficient μ between the belt ended the roller is large, and the contact angle θr is sufficiently large, the tension is equal to T2 at θp which is smaller than θr. The range to this point is effective to feed the belt. Within the region from the θp to the θr, the tension is constant (T2), and such a range is a margin for the feeding drive.

Figure 17:
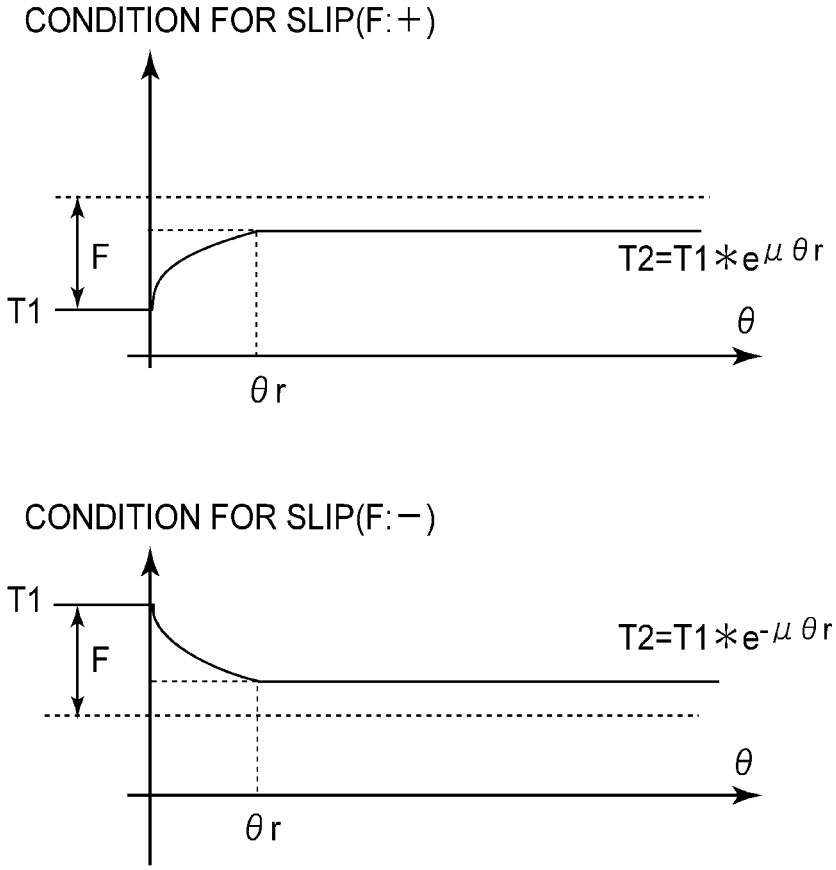
FIG. 17 illustrates an ordinary belt unit in which a relation between the steering operation and the color misregistration is shown.

On the other hand, if the μ is small, or θr is not sufficiently large, a slip occurs between the belt and the roller. A distribution of the tension in such a case is as shown in FIG. 17. The tension change in the range of the contact angle is not sufficient for the balance with the driving force or the load, and therefore, the forces do not balance with the result of slip between the belt and the roller.

Referring to the example of FIG. 11, a description will be made as to the reason why the feeding direction vector V of the stretching surface is controlled by the feeding direction vector of the downstream roller as expressed by equation (1).

In the belt winding on the roller as shown in FIG. 16, there is a region (0≤θ≤θp) from the contact ending portion we respect to the feeding direction determined by the Euler's formula to the angle θp. In such a region, the tension changes as expressed by equations (3) and (4), and this shows that the driving force or the load are transmitted by the maximum static friction force between the roller and the belt. When an external disturbance force it supplied to the belt tension T1 in the downstream side, the slip tends to occur in the region because the maximum static friction force is insufficient. When slip occurs, the tension the range upstream of θp changes again under the control of the Euler's formula to resists the external disturbance, and when the external disturbance disappears, the previous states is reestablished.

On the other hand, an external disturbance is supplied to the tension T2 in the upstream side, the external disturbance enters from the contact portion upstream of θp. This region (θp≤θ≤θr) does not contribute to the transmission of the driving force or the load between the belt and the roller, and therefore, the frictional force between the roller and the belt has a margin to the maximum static friction force. For this reason, no slip occurs between the roller and the belt against the external disturbance force from the upstream side.

When a difference is produced between the upstream feeding direction vector V2 and the downstream feeding direction vector V1 as shown in FIG. 14, an external disturbance force to the contact portion between the roller and the belt because the high Young's modulus belt such as a resin material belt cannot deform within the belts surface. In such a case, an external disturbance force is applied to the region θp≤θ≤θr of the downstream side roller, and therefore, that feeding direction vector V1 can be maintained against the external disturbance force, but an external disturbance is applied to the region 0≤θ≤θp of the upstream roller, with the result of slight slip, and therefore, the emergent direction of the belt cannot maintain V2, so that the direction of the vector V2 approaches to the V1 direction of the downstream roller.

As described above, the feeding direction vector of the stretching surface of the belt is controlled by the feeding direction vector V1 of the roller having a θp≤θ≤θr in the downstream side of the stretching surface.

The feeding direction (travelling direction) of the belt is the same as the moving direction of the mass point on the belt.

For this reason, when the roller pulling the surface opposed to the image forming station is a steering roller also functioning as a tension roller, a color misregistration in the main-scanning direction is produced in accordance with the amount of steering roller inclination caused by steering control.

<Relation Between Belt Position and Color Misregistration in Main-Scanning Direction>

A description will be made as to the relationship between the position of the belt with respect to the direction crossing with the feeding direction and the color misregistration in the main scanning direction. As described above, the three-dimensional inclination of the steering roller determines the feeding direction vector of the stretching surface of the belt, and therefore, become means the amount of color misregistration. As described, the influence of the amount of the steering roller inclination by the steering control is reflected in the three-dimensional inclination of the steering roller. However, it has been found that the position of the belt with respect to a direction perpendicular to the belt feeding direction is influential. This will be described.

Figure 18:
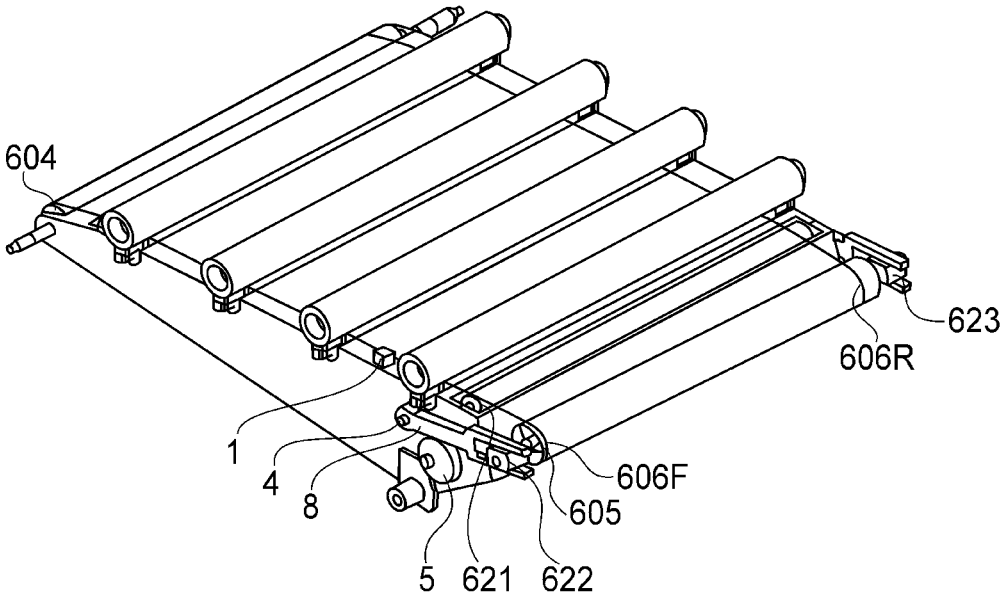
FIG. 18 illustrates a relation between a position of the belt and an inclination of the steering roller.
Figure 19:
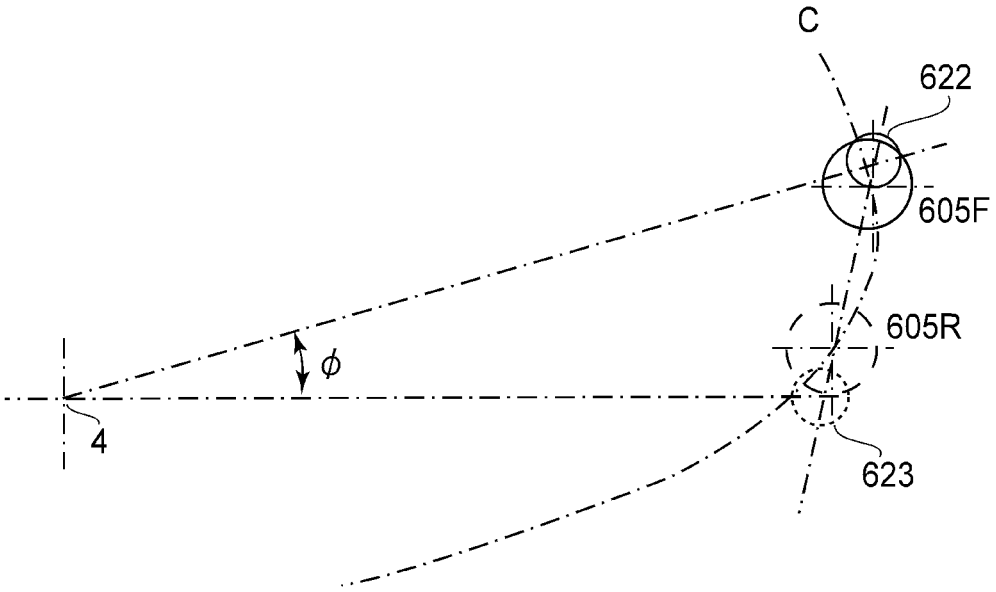
FIG. 19 illustrates a relation between a position of the belt and an inclination of the steering roller.
Figure 20:
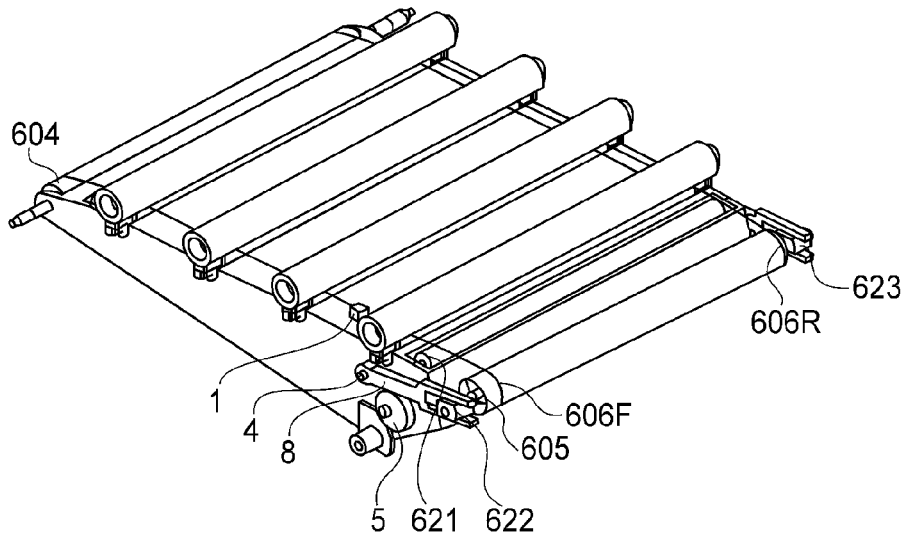
FIG. 20 illustrates a relation between a position of the belt and an inclination of the steering roller.
Figure 21:
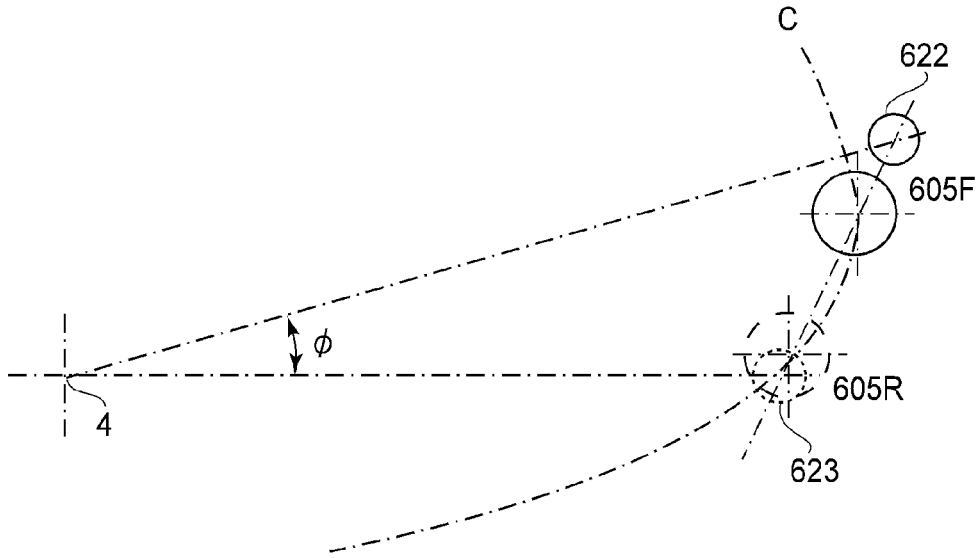
FIG. 21 illustrates a relation between a position of the belt and an inclination of the steering roller.

FIG. 18 shows a state in which the steering cam 5 is in a phase influential to the inclination angle of the steering roller, and the intermediary transfer belt 606 is offset toward the front side. FIG. 19 is a schematic view of an attitude of the steering roller as seen from the front side. FIGS. 20 and 21 are schematic view showing a state in which the steering cam 5 is in the same phase as that of FIG. 18, but the intermediary transfer belt 606 is offset toward the rear side. As shown in FIGS. 18, 19, what is determined by the phase of the steering cam 5 is the angle ϕ of the steering arm 8. Bearing portions 622, 623 supporting the steering roller 605 are supported slidably along respective lines inclined by the angle ϕ and urged toward the outside. The position of the steering roller 605 is determined against the urging force by the circumferential length of the intermediary transfer belt 606 which is constant. More particularly, the orbit of the belt is ellipse having the focal points at the forward and backward rollers, and the steering roller is supported at the front side end 605F and the rear side end 605R of the intermediary transfer belt. Under such a confining condition, as shown in FIGS. 20, 21, even if the phase of the steering cam 5 is the same, and the confining lines inclined by ϕ Are the same, the positions of the ends 605F, 605R are different if the belt offsets toward the rear side, with the result that the three dimensional inclination Of the steering roller 605 is different. Therefore, when the offset of the belt is within a small range, the change of the belt feeding direction and the amount of color misregistration can be determined only from the amount of the steering roller inclination resulting from the steering control, but when the offset of the belt is large, the position of the belt with respect to the direction crossing with the travelling direction of the belt is preferably taken into account to obtain the belt feeding direction change and that color misregistration amount with high precision.

<Calculation of Belt Feeding Direction>

As described in the foregoing, the change of the belt feeding direction influential to the color misregistration in the main scanning direction attributable to the belt feeding can be calculated from the amount of the steering roller inclination resulting from the steering control and the position of the belt with respect to the crossing direction. In the steering control of this embodiment, the amount of the steering roller inclination is determined by a PID control using the hysteresis of a plurality of deviations between the belt edge sensor outputs and the target belt positions. On the other hand, in the position of the belt in the crossing direction is expressed as the deviation between the belt edge sensor output and the target belt position. In other words, in this embodiment, the change of the belt feeding direction can be calculated from the hysteresis of the belt edge sensor output. This is expressed in the equation of (a) of FIG. 23. Here, u is the belt edge sensor output as an input, and y is a belt feeding direction as an output. The current belt feeding direction y (n) is determined by the hysteresis of y and the current value u and the hysteresis thereof, and is the equivalent to a state space formula of a transfer function of (b) of FIG. 23. By predetermining the required order (p, q or s) and the coefficients of the equation (a) or (b) of FIG. 23, the current belt feeding direction can be calculated by the hysteresis of the belt edge sensor output.

<Color Registration Control in the Main Scanning Direction During Image Formation>

A description will be made as to changing means for changing the writing starting position determined by the correcting mode on the basis of the difference between the moving direction calculated by the feeding direction calculating portion during the image writing position correcting mode operation and the moving direction calculated by the feeding direction calculating means during the image formation by the inputted image formation signal.

Referring back to FIG. 1, the color registration control in the main scanning direction during the image forming operation will be described.

When the image forming operation start is instructed (S840), the intermediary transfer belt drive is started (S841), and the steering control of FIG. 3 is started (S842). As long as the intermediary transfer belt is driven, the steering control of FIG. 3 is carried out normally, and the calculation of the feeding direction by the belt feeding direction calculating portion 51 is also carried out normally (S843). The image writing position correction value and the reference feeding direction which have been set as a result of the operation in the image writing position correcting mode are read out for each color by the storing means 703 (S844). The image writing position correction value is calculated on the basis of the difference between the belt feeding direction immediately before the image formation onto the sheet and the reference feeding direction in the manner which will be described hereinafter (S845), and then the image writing position correction modifying value is added to the read image writing position correction value, by which the image writing timing of the exposure device 611 is corrected (S846). Thereafter, the image formation for one page is started (S847). This series of correcting operations is carried out for each one page image formation until the continuous image forming operation is finished (S848, S849).

<Calculation of Image Modifying Position Correction Value>

FIG. 28 illustrates a locus of a given mass point Pt on the belt, in which an arrow directing from Pt to P'+dt shows the above-described belt feeding direction. The arrow is the reference feeding direction set during the operation in the image writing position correcting mode in FIG. 6. Here, one reference feeding direction is shown, but as will be understood from FIG. 6, the reference feeding direction is different depending on the columns.

In FIG. 28, Sr is a component of the reference feeding direction in the main-scanning direction, and dS is a difference between main-scanning direction component S of the current belt feeding direction and the main-scanning direction component Sr of the reference feeding direction.

$$dS=S-Sr \tag{7}$$

The reference feeding directions in the respective colors are as follows:

$$dSy=S-Sry \tag{8}$$

$$dSm=S-Srm \tag{9}$$

$$dSc=S-Src \quad (10)$$

$$dSb=S-Srb \quad (11)$$

Sry, Srm, Src, Srb are determined by the reference feeding directions of the respective colors.

If the image formation is executed in the state, the writing position deviations dY, dM, dC, dB on the intermediary transfer belt appear due to the dS, as shown in FIG. 28.

The dY, dM, dC, dB, dS are determined by dSy, dSm, dSc, dSb and the positions of the photosensitive drums 4Y, 4M, 4C, 4B.

$$dY=dSy\times LY/LS \quad (12)$$

$$dM=dSm\times LM/LS \quad (13)$$

$$dC=dSc\times LC/LS \quad (14)$$

$$dB=dSb\times LB/LS \quad (15)$$

Here, LS, LY, LM, LC, LB are determined from positional relationships between the starting point of the vector defining the feeding direction as shown in FIG. 28 and the photosensitive drums, but the starting point Pt may be any given point on the primary transfer surface. The values of dY, dM, dC, dB are different depending on the starting point Pt, but relative values indicating that color misregistration (dY−dM, for example) are not dependent on Pt and are expressed by the distances between the photosensitive drums and the length LS of the vector indicating the feeding direction.

In this embodiment, as shown in FIG. 1, the real time correction is effected using, as the image writing position correction value for each color, the values canceling the deviation amounts of (12)-(15) calculated on the basis of the current feeding direction and the reference feeding direction for each color set in the image writing position correcting mode operation, by which the color misregistration, with respect to the main scan direction (crossing with the belt travelling direction) can be reduced.

By doing so, the color misregistration in the main scanning direction attributable to the belt offset control which is normally carried out during movement of the intermediary transfer belt 606 as well as the image writing position correction attributable to the temperature rise or the like, can be corrected, and therefore, satisfactory image formation and prevention of the belt off-set to the limit.

As described in the foregoing, according to the first embodiment of the present invention, there is provided an image forming apparatus in which the average image position change for each color due to the temperature rise in the apparatus or the like can be corrected, and the color misregistration resulting from the belt feeding can be corrected, during image formation, with a simple structure, and therefore, the satisfactory image quality can be provided with small color misregistration in the main scan direction.

Embodiment 2

An apparatus according to the second embodiment will be described. The apparatus of this embodiment is different from the apparatus of embodiment 1 In the structure of the belt edge sensor, the steering control and the calculating portion for the belt feeding direction. Therefore, these portions only will be described for the sake of simplicity.

<Belt Edge Sensor>

FIG. 24 is a block diagram, and FIG. 25 is a schematic sectional view regarding this embodiment. In this embodiment, a belt edge sensor 2 is provided in an upstream side with respect to the belt moving direction in addition to the belt edge sensor 1. In the steering control which will be described hereinafter, and the steering roller it switched in response to the output of the belt edge sensor 1. In the belt feeding direction calculating portion 51, and the belt feeding direction is calculated from the outputs of the edge sensor 1 and the edge sensor 2.

<Steering Control>

Referring first to FIG. 26, the steering control of the steering mechanism 201 will be described. When the image formation instructions is produced or when the drive of the intermediary transfer belt is started in the image adjusting modes (S900), the drive start command is supplied to the belt drive motor driver 700 from the controller 50 shown in FIG. 24 (S901). Simultaneously, the command for setting the amount of the steering roller inclination to A is supplied to the steering cam drive motor driver 701 (S902). In the steering roller inclination amount is such that the belt necessarily offsets toward the front side. The controller 50 starts to obtain the belt edge positional data from the belt edge sensor 1 (S903). When the belt shifts frontwardly to such an extent of the predetermined front side limit (S904), the amount of the steering roller inclination is set to B (S905). The steering roller inclination amount B is such that the belt is necessarily shifted toward the rear side. When the belt shifts rearwardly to such an extent of the predetermined rear side limit (S906), the amount of the steering roller inclination is set to A (S907). These operations are normally repeated (S908) as long as the intermediary transfer belt is driven, and when the stop command for the belt drive is produced (S909), the belt is stopped (S910).

By such control operations, the belt is controlled to make the snaking movement as shown in (a) of FIG. 27. In such control operations, the belt is controlled gently while being prevented from offset-to-limit, and therefore, a simple steering mechanism can be employed.

<Calculation of Belt Feeding Direction and Position Correction Modifying Value>

According to this embodiment, the belt feeding direction can be calculated more accurately on the basis of the detected data of the plurality of belts position detecting means, namely the belt edge sensor 1 and the belt edge sensor 2.

Part (b) of FIG. 27 is a graph illustrating movement distance S in the main-scanning direction caused by the variation in the feeding direction of the intermediary transfer belt shown in FIG. 28. The component S of the variation of the belt feeding direction in the main-scanning direction is calculated as follows:

$$S(t+dt)=E1(t+dt)-E2(t) \quad (16)$$

Here, E1 (t+dt) is an output of the downstream edge sensor 1 at t+dt, and E2 (*t*) is an output of the upstream edge sensor 2 at t. In addition, dt is time duration in which the belt is fed from the edge sensor 2 to the edge sensor 1, and is expressed by the feeding speed of the belt PS And the distance LS between the edge sensor 2 and the edge sensor 1, as follows:

$$dt=LS/PS \quad (17)$$

When, for example, LS=600 [mm], and PS=300 [mm/sec], $$dt=2\ [\text{sec}] \quad (18)$$

Using the calculated S, the image position correction modifying value is calculated similarly to embodiment 1. In this embodiment, LS, LY, LM, LC, LB in formulae (12)-(15) may be the values obtained from the positional relations between the two edge sensors and each drum. That is, 1 in FIG. 28 is taken as the belt edge sensor 1, and 2 is taken as the belt edge sensor 2.

Similarly to embodiment 1, in this embodiment, as shown in FIG. 1, the real time correction is effected using, as the image writing position correction value for each color, the values canceling the deviation amounts of (12)-(15) calculated on the basis of the current feeding direction and the reference feeding direction for each color set in the image writing position correcting mode operation, by which the color misregistration, with respect to the main scan direction (crossing with the belt travelling direction) can be reduced.

Embodiment 3

The apparatus of the third embodiment will be described, in which only the steering control and the calculating portion for the belt feeding direction are different from those of the apparatus of embodiment 1. Therefore, these portion only will be described for the sake of simplicity.

<Steering Control>

The steering control of this embodiment is similar to that of embodiment 2 shown in FIG. 26.

<Calculating Portion For Belt Feeding Direction>

FIG. 29 is a block diagram regarding this embodiment. To the calculating portion 51 for the belt feeding direction which is the belt feeding direction detecting means, the amount of the steering roller inclination is set by the controller 50, and the position of the belt with respect to the direction crossing with the travelling direction thereof is inputted from the belt edge sensor 1 substantially in real-time. The feeding direction calculating means 51 calculates the belt feeding direction on the basis of the mechanism described as to embodiment 1, at <Inclination of roller and feeding direction of belt> and <Relation between belt position and color misregistration in main-scanning direction>. More specifically, in the processing, a table shown in FIG. 30 is prepared beforehand, and the actual image writing position correction value in FIG. 1 Is calculated using the table, and the color misregistration correction is carried out substantially in real time.

Embodiment 4

The apparatus of fourth embodiment will boot described. The apparatus of this embodiment is different from that of embodiment 3 only in that position detecting means with respect to the direction crossing with the travelling direction of the belt and into calculation of the calculating portion 51 for the belt feeding direction. FIG. 31 is a schematic view of the intermediary transfer belt unit according to this embodiment, and FIG. 32 is a block diagram regarding this embodiment.

In embodiment 3, the belt edge sensor 1 can continuously detect the position of the belt with respect to the direction crossing with the travelling direction at a given position within a predetermined range. In this embodiment, the use is made with the belt offset to the limit is detected by detecting means 1001 and 1002 using a photo-interruptor. The detecting means 1001, 1002 cannot detect the belt position at an arbitrary point, but the event that the belt position becomes beyond a predetermined limit. Using this, the belt steering control can be effected similarly to FIG. 26 of embodiment 3.

On the other hand, the feeding direction of the belt is calculated as follows. The controller 50 carries out steering control output of FIG. 26 and starts the measurement of the travelling distance of the belt when the output of the detecting means 1001, 1002 indicates the event that the belt reaches the limit position.

The measurement of the travelling distance continues to the next arrival at the limit position and is integrated as follows:

$$\int PS(t)*dt \tag{19}$$

where PS(t) is a travelling speed set value of the belt.

The travelling distance Lfr in the case of rearward offset of the belt and the travelling distance Lrf in the case of the frontward offset are renewed each time the arrival at the limit position. And, the controller 50 calculates the current position Xb in the direction crossing with the travelling direction of the belt is calculated. When the front side limit position is Xlimf, and the rear side limit position is Xlimr, and when the belt is offset toward the rear side, $$Xb=(Xlimr-Xlimf)*\{\int PS(t)*dt\}/(Lfr+Xlimf) \tag{20}$$

And, when the belt offset toward the front side, $$Xb=(Xlimf-Xlimr)*\{\int PS(t)*dt\}/(Lrf+Xlimr) \tag{20}$$

Such approximate calculated values of the belt position are outputted from the controller 50 to the belt feeding direction calculating portion 51 substantially in real time, by which the controller 51 can effect the belt feeding direction calculation similarly to embodiment 3, and therefore, satisfactory image with less color misregistration in the main scanning direction can be provided with an inexpensive detecting means for detecting the belt offset to the limit.

According to the present invention, the change of the average position of the image of each color attributable to the temperature rise in the apparatus or the like is collected, and the color misregistration attributable to the belt feeding is also collected, a satisfactory image quality with relatively less color misregistration with respect to the main scan direction can be provided.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 243171/2009 filed Oct. 22, 2009 which is hereby incorporated by reference.

What is claimed is:

1. An apparatus comprising:

a rotatable belt;

a first image bearing member configured to bear an electrostatic latent image, which is to be developed into a toner image;

a second image bearing member, provided at a position downstream of said first image bearing member with respect to the rotational moving direction of said belt, configured to bear an electrostatic latent image, which is to be developed into a toner image;

a first detecting member provided adjacent said second image bearing member with respect to the rotational moving direction of said belt and configured to detect a position of said belt with respect to a widthwise direction;

a second detecting member provided adjacent said first image bearing member with respect to the rotational moving direction of said belt and configured to detect a position of said belt with respect to the widthwise direction;

a steering roller configured to stretch said belt and configured to movably control the position of said belt with respect to the widthwise direction by inclination thereof;

a first stretching roller, disposed at a position adjacent said steering roller, configured to stretch at one end portion of an image formation region of said belt along which said image bearing members are arranged;

a second stretching roller, disposed adjacent said steering roller on an opposite side from said first stretching roller with respect to said steering roller, configured to stretch said belt, wherein a first distance between rotational axes of said steering roller and said first stretching roller measured along a plane perpendicular to the rotational axis of said steering roller is different from a second distance between rotational axes of said steering roller and said second stretching roller measured along the plane;

an executing portion configured to execute an operation in a correction mode for determining timing at which formation of the electrostatic latent image starts on at least one of said first and second image bearing members with respect to the widthwise direction of said belt, which is crossing with a rotational direction of said belt, on the basis of a positional relation, with respect to the widthwise direction, between test toner images transferred onto said belt from said first and second image bearing members;

a calculating portion configured to calculate a movement distance of a predetermined point on said belt with respect to the widthwise direction from a position of said second detecting member to a position of said first detecting member in the rotational moving direction; and an adjusting portion configured to adjust the timing determined by said executing portion, on the basis of a result of the calculation of said calculating portion in an operation of the correction mode and a result of the calculation of said calculating portion when the image is to be formed in accordance with an image formation signal.

2. An apparatus according to claim 1, wherein said belt is made of material having a Young's modulus high enough so expansion and contraction are negligible.

3. An apparatus comprising:

a rotatable belt;

a first image bearing member configured to bear an electrostatic latent image, which is to be developed into a toner image;

a second image bearing member, provided at a position downstream of said first image bearing member with respect to the rotational moving direction of said belt, configured to bear an electrostatic latent image, which is to be developed into a toner image;

a first detecting member provided adjacent said second image bearing member with respect to the rotational moving direction of said belt and configured to detect a position of said belt with respect to a widthwise direction;

a second detecting member provided adjacent said first image bearing member with respect to the rotational moving direction of said belt and configured to detect a position of said belt with respect to the widthwise direction;

a steering roller configured to stretch said belt and configured to movably control the position of said belt with respect to the widthwise direction by inclination thereof;

a first stretching roller, disposed at a position adjacent said steering roller, configured to stretch at one end portion of an image formation region of said belt along which said image bearing members are arranged;

a second stretching roller, disposed adjacent said steering roller on an opposite side from said first stretching roller with respect to said steering roller, configured to stretch said belt, wherein a first distance between rotational axes of said steering roller and said first stretching roller measured along a plane perpendicular to the rotational axis of said steering roller is different from a second distance between rotational axes of said steering roller and said second stretching roller measured along the plane;

an executing portion configured to execute an operation in a correction mode for determining timing at which formation of the electrostatic latent image starts on at least one of said first and second image bearing members with respect to the widthwise direction of said belt, which is crossing with a rotational direction of said belt, on the basis of a positional relation, with respect to the widthwise direction, between test toner images transferred onto said belt from said first and second image bearing members; and an adjusting portion configured to adjust the timing determined by said executing portion, on the basis of a result of a movement distance of a predetermined point on said belt with respect to the widthwise direction from a position of said second detecting member to a position of said first detecting member in the rotational moving direction in an operation of the correction mode and on the basis of a result of a movement distance of a predetermined point on said belt with respect to the widthwise direction from a position of said second detecting member to a position of said first detecting member in the rotational moving direction when the image is to be formed in accordance with an image formation signal.

4. An apparatus according to claim 3, wherein the predetermined point is at an edge of said belt.

5. An apparatus according to claim 4, wherein when a distance from the second detecting member to the first detecting member in the rotational direction of said belt divided by a rotational movement speed of said belt is dt, the movement distance is a difference between the result of detection of said first detecting member at time t+dt and the result of detection of said second detecting member at time t.

6. An apparatus according to claim 3, wherein said adjusting portion effects the adjustment for each image forming operation on a recording material.

7. An apparatus according to claim 3, wherein said first and second image bearing members are photosensitive members, and further comprising first and second exposure devices configured to form the electrostatic latent images by exposure of said first and second image bearing members to light after said first and second image bearing members are charged, and wherein the timing is adjusted for each of said first and second exposure devices.

8. An apparatus comprising:

a rotatable belt;

first and second stretching members configured to stretch said belt;

first and second image bearing members, provided opposite to said belt, configured to carry toner images to be transferred onto said belt, wherein said first image bearing member is disposed upstream of said second image bearing member with respect to a rotational movement direction of said belt;

first and second detecting members, provided at an end portion of said belt with respect to a widthwise direction which is perpendicular to the rotational movement direction, configured to detect a predetermined position of said belt with respect to the widthwise direction, wherein said second detecting member is disposed upstream of said first detecting member with respect to the rotational movement direction;

an executing portion configured to execute a toner position detecting mode operation to detect positions of test toner transferred from said first and second image bearing members, the toner position detecting mode operation being carried out in a period other than an image formation period in which an image is formed on a recording material to output signals indicative of the positions of the test toner; and a setting portion configured to set positions of the toner images on said first and second image bearing members with respect to the widthwise direction during the image formation period, on the basis of the signals, detection results of said first and second detecting members during the toner position detecting mode operation, and detection results of said first and second detecting members before forming the toner images during the image formation period.

9. An apparatus according to claim 8, wherein the predetermined position is at an edge of said belt.

10. An apparatus according to claim 8, wherein said setting portion sets the positions of the toner images on said first and second image bearing members on the basis of an output of said second detecting member at time t and an output of said first detecting member at time t+dt, wherein dt is time required by said belt moving from said second detecting member to said first detecting member.

11. An apparatus according to claim 8, wherein said setting portion sets the positions of the toner images of said first and second image bearing members for each image forming operation on the recording material.

12. An apparatus according to claim 8, wherein said first and second image bearing members are photosensitive members, respectively, and said apparatus further comprises a charging device configured to charge said photosensitive members and an exposure device configured to expose said photosensitive members charged by said charging device, wherein said setting portion sets exposure timing of said exposure device to set the positions of the toner images on said first and second image bearing members.

* * * * *